US006888474B2

(12) United States Patent
Sharp et al.

(10) Patent No.: US 6,888,474 B2
(45) Date of Patent: May 3, 2005

(54) SYSTEM AND METHOD FOR CONFIGURING AN ELECTRONICALLY STEERABLE BEAM OF A TRAFFIC SIGNAL LIGHT

(75) Inventors: Frank M. Sharp, Dallas, TX (US); Michael C. Hutchison, Plano, TX (US); Tom Shinham, Rowlett, TX (US)

(73) Assignee: Optisoft, Inc., Richardson, TX (US)

( * ) Notice: Subject to any disclaimer, the term of this patent is extended or adjusted under 35 U.S.C. 154(b) by 71 days.

(21) Appl. No.: 10/643,135

(22) Filed: Aug. 18, 2003

(65) Prior Publication Data

US 2004/0070520 A1 Apr. 15, 2004

Related U.S. Application Data

(63) Continuation-in-part of application No. 09/649,661, filed on Aug. 29, 2000, now Pat. No. 6,614,358.

(51) Int. Cl.[7] ..... G08G 1/095

(52) U.S. Cl. ..... 340/907; 340/908; 340/909; 340/310.01; 340/815.4

(58) Field of Search ..... 340/907, 908, 340/909, 310.01, 815.4, 815.41, 815.45, 815.55, 815.83

(56) References Cited

U.S. PATENT DOCUMENTS

| | | | | |
|---|---|---|---|---|
| 5,132,682 A | * | 7/1992 | Higgins et al. | 340/931 |
| 5,309,155 A | * | 5/1994 | Hsien et al. | 340/907 |
| 6,323,781 B1 | | 11/2001 | Hutchison | |
| 6,441,750 B1 | | 8/2002 | Hutchison | |
| 6,450,662 B1 | | 9/2002 | Hutchison | |
| 6,577,247 B2 | * | 6/2003 | Giacaman | 340/907 |

* cited by examiner

*Primary Examiner*—Toan N. Pham

(57) ABSTRACT

The present invention discloses a method, system, and computer readable medium for configuring an electronically steerable beam of a traffic signal light (234). The system comprises a wireless device (232) adapted to send at least one command to change a viewing angle of the traffic signal light (234), and a control unit (252) adapted to receive the command, the control unit (252) further adapted to send the command to the traffic signal light (234), wherein the command adjusts a viewing angle of at least a portion of the traffic signal light (234).

46 Claims, 24 Drawing Sheets

WIRLESS DEVICE

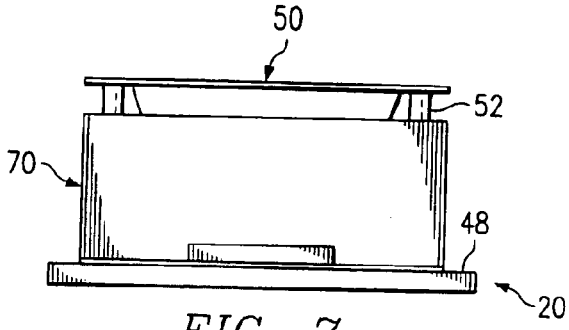
FIG. 7
FIG. 8
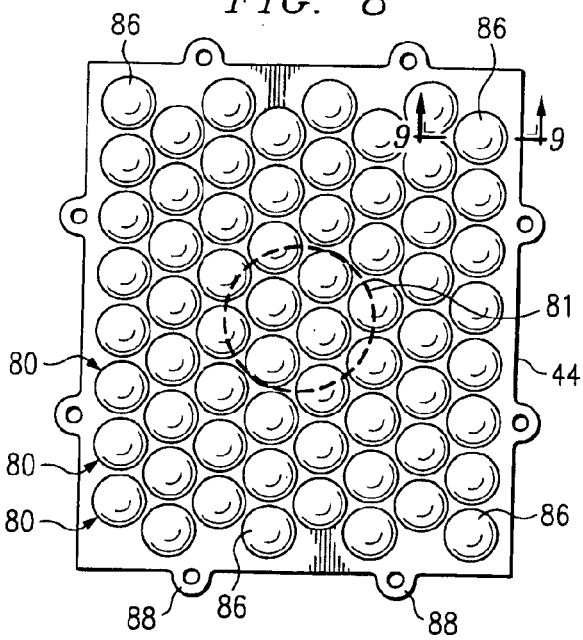
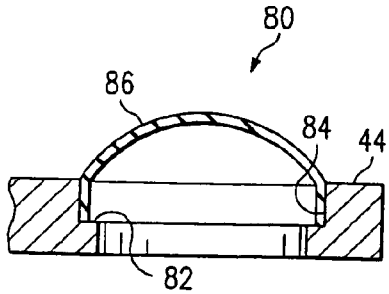
FIG. 9

FIG. 10
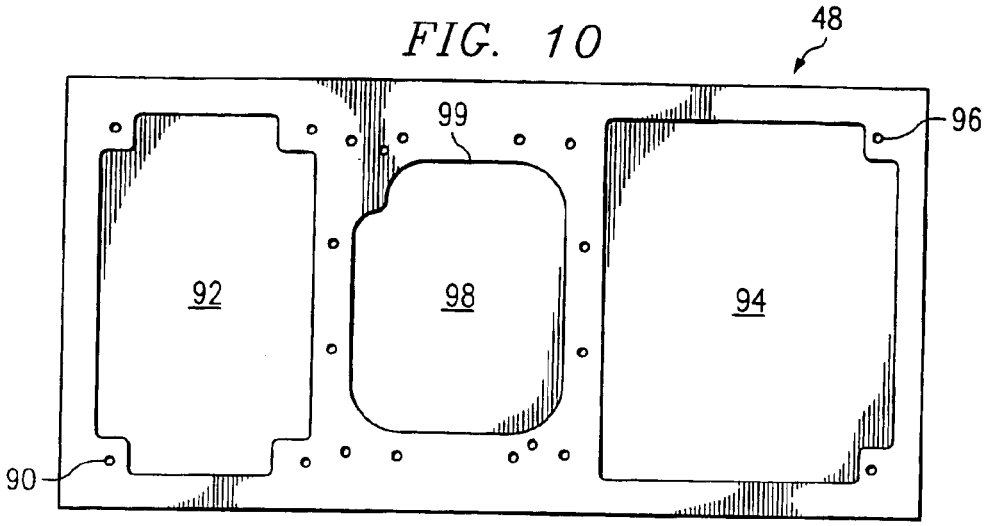
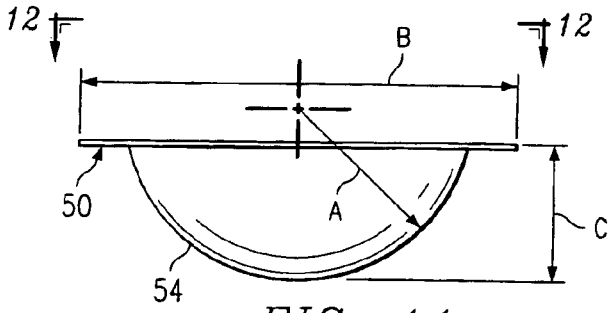
FIG. 11
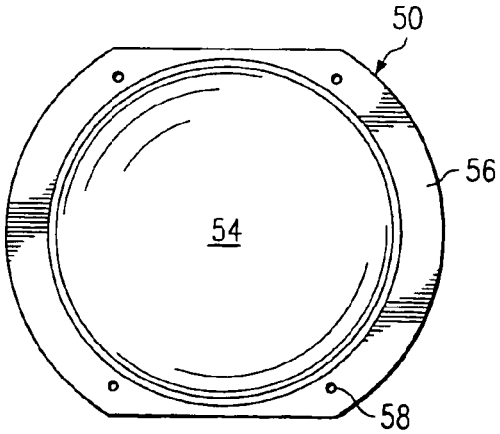
FIG. 12
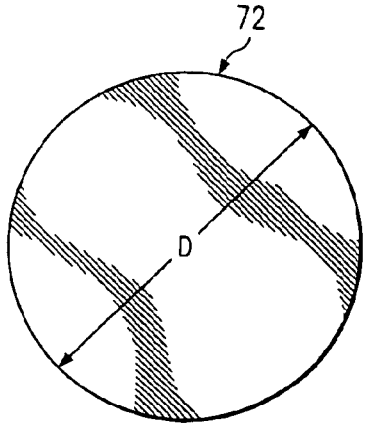
FIG. 13

280

SYSTEM AND METHOD FOR CONFIGURING AN ELECTRONICALLY STEERABLE BEAM OF A TRAFFIC SIGNAL LIGHT

CROSS REFERENCE TO RELATED APPLICATION

The present application is a Continuation-In-Part of U.S. patent application Ser. No. 09/649,661 filed Aug. 29, 2000, now U.S. Pat. No. 6,614,358 entitled SOLID STATE LIGHT WITH CONTROLLED LIGHT OUTPUT, the teachings of which are incorporated by reference herein.

FIELD OF THE INVENTION

The present invention is generally related to light sources, and more particularly to traffic signal lights including those incorporating both incandescent and solid state light sources, and to configuring an electronically steerable beam of a traffic signal light.

BACKGROUND OF THE INVENTION

Traffic signal lights have been around for years and are used to efficiently control traffic through intersections. While traffic signals have been around for years, improvements continue to be made in the areas of traffic signal light control algorithms, traffic volume detection, and emergency vehicle detection.

There continues to be a need to be able to predict when a traffic signal light source will fail. The safety issues of an unreliable traffic signal are obvious. The primary failure mechanism of an incandescent light source is an abrupt termination of the light output caused by filament breakage. The primary failure mechanism of a solid state light source is gradual decreasing of light output over time, and then ultimately, no light output.

The current state of the art for solid state light sources is as direct replacements for incandescent light sources. The life time of traditional solid state light sources is far longer than incandescent light sources, currently having a useful operational life of 10–100 times that of traditional incandescent light sources. This additional life time helps compensate for the additional cost associated with solid state light sources.

However, solid state light sources are still traditionally used in the same way as incandescent light sources, that is, continuing to operate the solid state light source until the light output is insufficient or non existent, and then replacing the light source. The light output is traditionally measured by a person with a light meter, measuring the light output from the solid state light source from a Department of Transportation (DOT) "bucket".

Other problems with traditional traffic signal light sources is the intense heat generated by the light source. In particular, temperature greatly affects the life time of solid state light sources. If the temperature can be reduced, the operational life of the solid state light source may increase between 3 fold and 10 fold. Traditionally, solid state light sources today are designed as individual light emitting diodes (LEDs) individually mounted to a printed circuit board (PCB), and placed in a protective enclosure. This protective enclosure produces a large amount of heat and has severe heat dissipation problems, thereby reducing the life of the solid state light source dramatically.

In addition to temperature, oxidation also greatly effects the lifetime of solid state light sources. For instance, when oxygen is allowed to combine with aluminum on an aluminum gallium arsenide phosphorus (AlInGaP) LED, oxidation will occur and the light output is significantly reduced.

With specific regards to solid state light sources, typical solid state light sources comprised of LEDs are traditionally too bright early in their life, and yet not bright enough in their later stages of life. Traditional solid state light sources used in traffic control signals are traditionally over driven initially so that when the light reduces later, the light output is still at a proper level meeting DOT requirements. However, this overdrive significantly reduces the life of the LED device due to the increased, and unnecessary, drive power and associated heat of the device during the early term of use. Thus, not only is the cost for operating the signal increased, but more importantly, the overall life of the device is significantly reduced by overdriving the solid state light source during the initial term of operation.

Still another problem with traditional light sources for traffic signals is detection of the light output using the traditional hand held meter. Ambient light greatly affects the accurate detection of light output from the light source. Therefore, it has been difficult in the past to precisely set the light output to a level that meets DOT standards, but which light source is not over driven to the point of providing more light than necessary, which as previously mentioned, increases temperature and degrades the useful life of the solid state device.

Still another problem in prior art traffic signals is that signal visibility needs to be controlled so only specific lanes of traffic are able to see the traffic light. An example is when a left turn lane has a green light, and an adjacent lane is designated as a straight lane. It is necessary for traffic in the left turn lane to see the green light. The current visibility control mechanism is mechanical, typically implementing a set of baffles inserted into the light system to carefully point the light in the left lane in the correct direction. The mechanical direction system is not very controllable because it is controlled in only one dimension, typically either up or down, or, either right or left, but not both. Consequently, the light is undesirable often seen in the adjacent lane. There is arisen a need for a better method to control the visibility range of a traffic signal.

Traditionally, old technology is typically replaced with new technology by simply disposing of the old technology traffic devices. Since most cities don't have the budget to replace all traffic control devices when new ones come to market, they have traditionally taken the position of replacing only a portion of the cities devices at any given time, thereby increasing the inventory needed for the city. Larger cities end up inventorying between four and five different manufacture's traffic signals, some of which are not in production any longer. The added cost is not only for storage of inventoried items, but also the overhead of taking all different types of equipment to a repair site, or cataloging the different inventoried items at different locations.

With respect to alignment systems for traffic lights, traditionally alignment traffic control devices provide that one person points the generated light beam in the desired direction from a bucket while above the intersection, while another person stands in the traffic lanes to determine if the light is aligned properly. The person on the ground has to move over the entire field of view to check the light alignment. If the light is masked off (such as a turn arrow), there are more alignment iterations. There is desired a faster and more reliable method of aligning traffic signals.

Traffic lights also have a problem during darker conditions, i.e. at night or at dusk when the light is not well defined. This causes a problem if the light has to be masked off for any reason, whereby light may overlap to areas that should be off. This imprecise on/off boundary is called "ghosting". There is a need to find an improved way to define the light/dark boundary of the traffic light to reduce ghosting. The ghosting is primarily caused by the angle the light hits on the "risers" on a Fresnel lens. A traffic light with a longer focal length reduces the angle, therefore decreasing the amount of ghosting. Therefore, devices with shorter focal lengths have increased ghosting. Another cause of ghosting is stray light from arrays of LED lights. Typical LED designs have a rather large intensity peek, that is, a less uniform beam of light being generated from the array.

Still another problem in prior art traffic signals is that signal visibility needs to be precisely controlled. An electronically steerable beam of a traffic signal light allows a viewing angle of a traffic signal light to be changed in order to enhance the safety of an intersection. Precisely controlling such a beam via a wireless device and altering the viewing angle of the traffic signal light eliminates possible ambiguity associated with an intersection having multiple traffic signal lights, light ball lenses and traffic signals. The wireless device allows the beam, and thus the viewing angle, to be altered from the vantage point of a vehicle at an intersection. From this point of view, a traffic engineer, for example, can interactively determine an optimal viewing angle of the signal. There is arisen a need for a better method to precisely control the visibility of a traffic signal.

SUMMARY OF THE INVENTION

The present invention achieves technical advantages as a system, method, and computer readable medium for configuring an electronically steerable beam of a traffic signal light to a desired viewing angle via a wireless device using an interactive methodology.

In one embodiment, a method for configuring an electronically steerable beam of a traffic signal light comprises receiving at least one command to change a viewing angle of a traffic signal light, translating the command to a power line command, sending the power line command to the traffic signal light, wherein the power line command effects an electronic steerable beam of the traffic signal light, and adjusting a viewing angle of at least a portion of the traffic signal light based on the power line command.

In another embodiment, a computer readable medium comprises instructions for receiving a command to change a viewing angle of at least one traffic signal light, wherein the traffic signal light comprises an array of columns and rows, performing at least one of a following action, based on the command, from a group consisting of: turning at least one of the columns on, turning at least one of the columns off, turning at least one of the rows on, and turning at least one of the rows off, and changing the viewing angle based on the performed action.

In a further embodiment, a method for configuring an electronically steerable beam of a traffic signal light comprises selecting a vantage point for beam steering, adjusting at least one of a following viewing perspective of the traffic signal light from a group consisting of: a horizontal viewing angle, a horizontal viewing width, a vertical viewing angle, and a vertical viewing width, and setting the adjusted at least one of the viewing perspectives.

In yet another embodiment, a system for configuring an electronically steerable beam of a traffic signal light comprises a wireless device adapted to send at least one command to change a viewing angle of a traffic signal light, a control unit adapted to receive the command, the control unit further adapted to: translate the command to a power line command, send the power line command to the traffic signal light, wherein the power line command effects an electronic steerable beam of the traffic signal light, and adjust a viewing angle of at least a portion of the traffic signal light based on the power line command.

In yet a further embodiment, a system for configuring an electronically steerable beam of a traffic signal light comprises a wireless device adapted to send at least one command to change a viewing angle of a traffic signal light, and a control unit adapted to receive the command, the control unit further adapted to send the command to the traffic signal light, wherein the command adjusts a viewing angle of at least a portion of the traffic signal light.

In still another embodiment, an electronic device comprises means for receiving at least one command to change a viewing angle of a traffic signal light, means for translating the command to a power line command, means for sending the power line command to the traffic signal light, wherein the power line command effects an electronically steerable beam of the traffic signal light, and means for adjust a viewing angle of at least a portion of the traffic signal light based on the power line command.

In still a further embodiment, a wireless device adapted to configure an electronically steerable beam of a traffic signal light to a desirable viewing angle and viewing width, wherein the traffic signal light comprises an array of columns and rows consisting of light emitting diodes, comprises means for performing at least one of a following action from a group consisting of: shift left, shift right, all columns on, all columns off, all rows on, all rows off, increase horizontal viewing angle, decrease horizontal viewing angle, shift up, shift down, increase vertical viewing angle, and decrease vertical viewing angle.

BRIEF DESCRIPTION OF THE DRAWINGS

FIG. 7 is a side view of the electronics assembly of FIG. 4;

FIG. 8 is a top view of the lens holder adapted to hold lenses for the array of LEDs;

FIG. 9 is a sectional view taken alone lines 9—9 in FIG. 8 illustrating a shoulder and side wall adapted to securely receive a respective lens for a LED mounted thereunder;

FIG. 10 is a top view of the heatsink comprised of a thermally conductive material and adapted to securingly receive each LED, the LED holder of FIG. 8, as well as the other componentry;

FIG. 11 is a side view of the light diffuser depicting its radius of curvature;

FIG. 12 is a top view of the light diffuser of FIG. 11 illustrating the mounting flanges thereof;

FIG. 13 is a top view of a Fresnel lens as shown in FIG. 3;

DETAILED DESCRIPTION OF THE PREFERRED EMBODIMENT

Figure 1B:
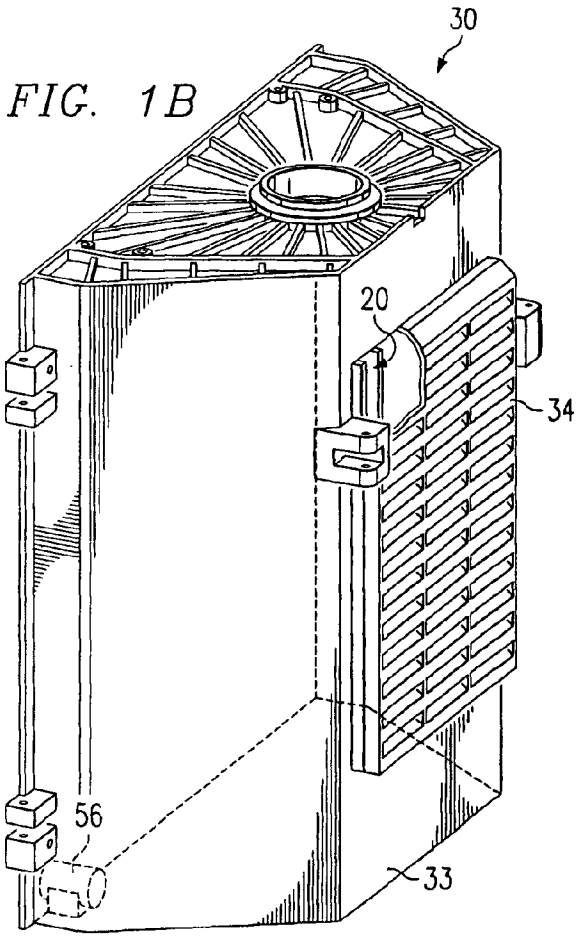
FIG. 1A and FIG. 1B is a front perspective view and rear perspective view, respectively, of a solid state light apparatus according to a first preferred embodiment of the present invention including an optical alignment eye piece.
Figure 1A:
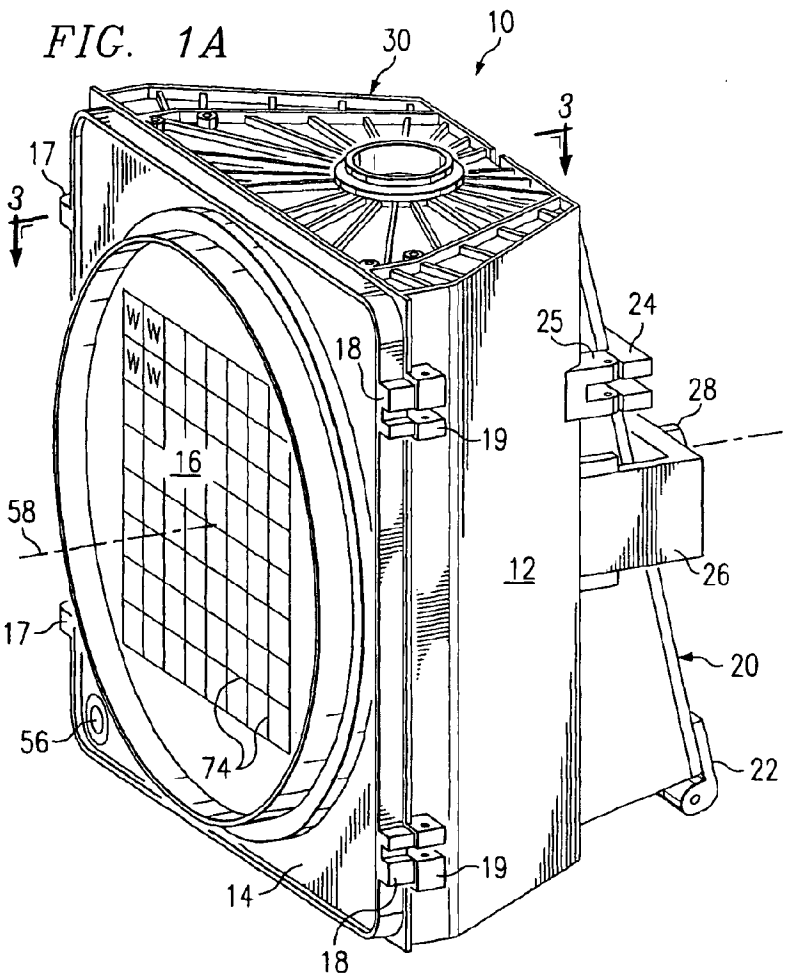

Referring now to FIG. 1A, there is illustrated generally at 10 a front perspective view of a solid state lamp apparatus according to a first preferred embodiment of the present invention. Light apparatus 10 is seen to comprise a trapezoidal shaped housing 12, preferably comprised of plastic formed by a plastic molding injection techniques, and having adapted to the front thereof a pivoting lid 14. Lid 14 is seen to have a window 16, as will be discussed shortly, permitting light generated from within housing 12 to be emitted as a light beam therethrough. Lid 14 is selectively and securable attached to housing 12 via a hinge assemble 17 and secured via latch 18 which is juxtaposed with respect to a housing latch 19, as shown.

Figure 2B:
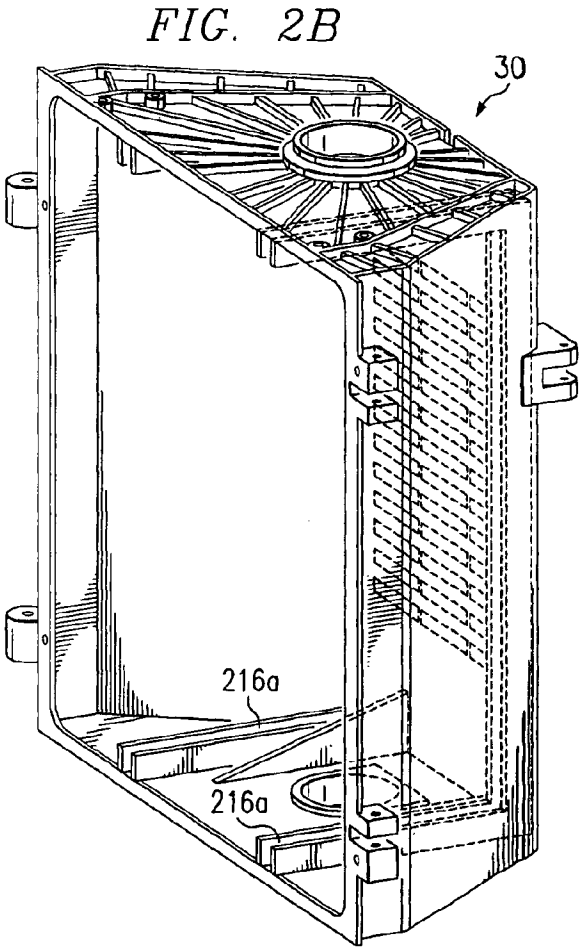
FIG. 2A and FIG. 2B is a front perspective view and a rear perspective view, respectively, of a second preferred embodiment having a solar louvered external air cooled heatsink.

Referring now to FIG. 1B and FIG. 2B, there is illustrated a second preferred embodiment of the present invention at 32 similar to apparatus 10, whereby a housing 33 includes a solar louver 34 as shown in FIG. 2B. The solar louver 34 is secured to housing 33 and disposed over a external heatsink 20 which shields the external heatsink 20 from solar radiation while permitting outside airflow across the heatsink 20 and under the shield 34, thereby significantly improving cooling efficiency as will be discussed more shortly.

Figure 2A:
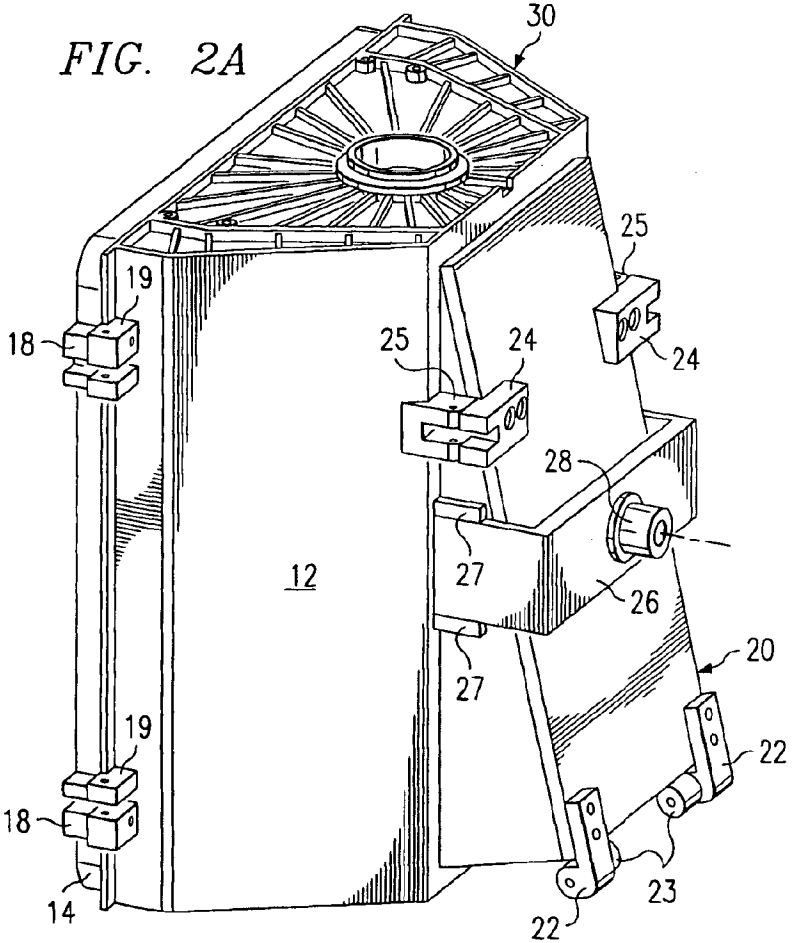

Referring to FIG. 2A, there is shown light apparatus 10 of FIG. 1A having a rear removable back member 20 comprised of thermally conductive material and forming a heatsink for radiating heat generated by the internal solid state light source, to be discussed shortly. Heatsink 20 is seen to have secured thereto a pair hinges 22 which are rotatably coupled to respective hinge members 23 which are securely attached and integral to the bottom of the housing 12, as shown. Heatsink 20 is further seen to include a pair of opposing upper latches 24 selectively securable to respective opposing latches 25 forming an integral portion of and secured to housing 12. By selectively disconnecting latches 24 from respective latches 25, the entire rear heatsink 20 may be pivoted about members 23 to access the internal portion of housing 12, as well as the light assembly secured to the front surface of heatsink 20, as will be discussed shortly in regards to FIG. 3.

Figure 3:
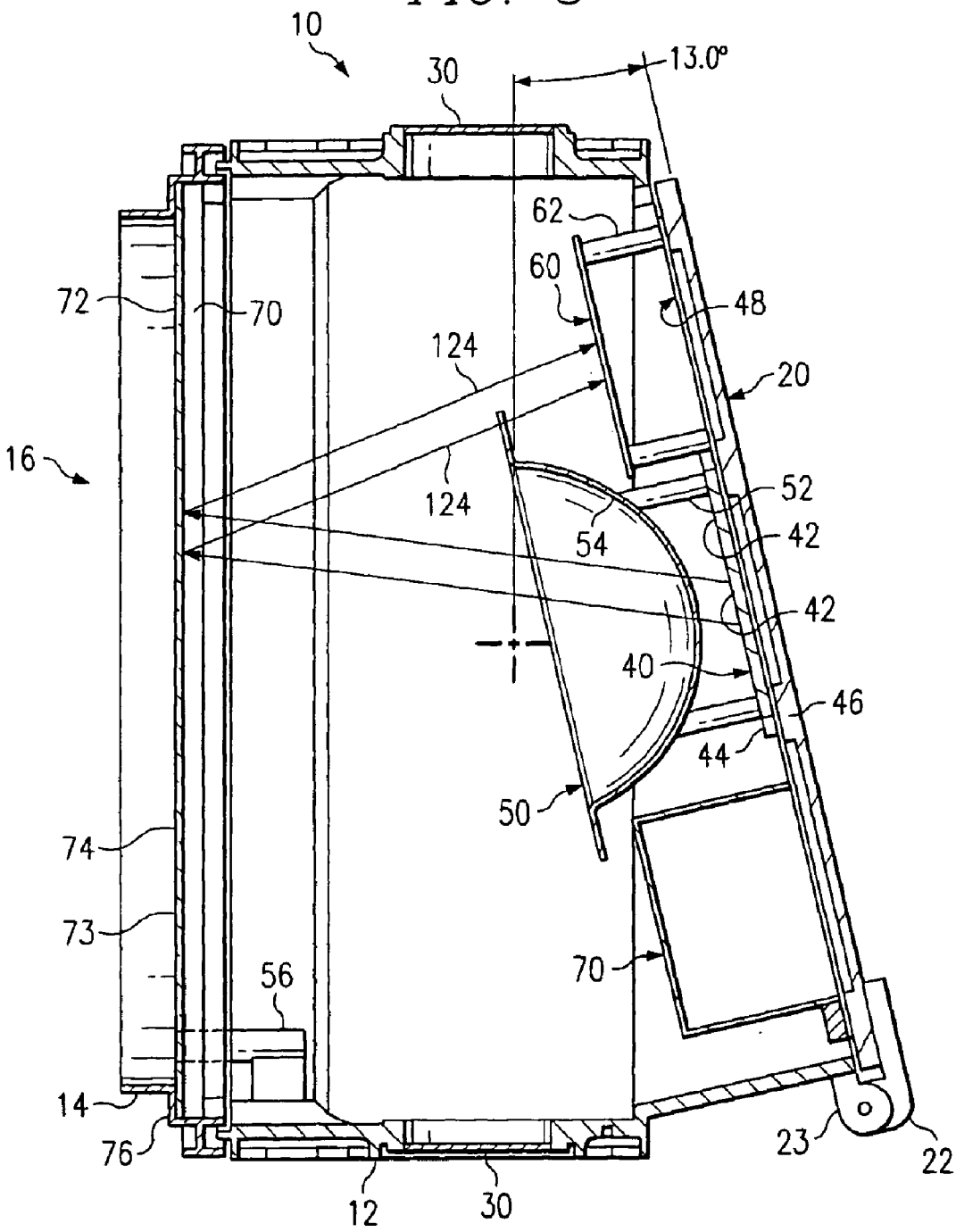
FIG. 3 is a side sectional view of the apparatus shown in FIG. 1 illustrating the electronic and optical assembly and lens system comprising an array of LEDs directly mounted to a heatsink, directing light through a diffuser and through a Fresnel lens.

Still referring to FIG. 2A, light apparatus 10 is further seen to include a rear eye piece 26 including a U-shaped bracket extending about heatsink 20 and secured to housing 12 by slidably locking into a pair of respective locking members 29 securely affixed to respective sidewalls of housing 12. Eye piece 26 is also seen to have a cylindrical optical sight member 28 formed at a central portion of, and extending rearward from, housing 12 to permit a user to optically view through apparatus 10 via optically aligned window 16 to determine the direction a light beam, and each LED, is directed, as will be described in more detail with reference to FIG. 14 and FIG. 15. Also shown is housing 12 having an upper opening 30 with a serrated collar centrally located within the top portion of housing 12, and opposing opening 30 at the lower end thereof, as shown in FIG. 3. Openings 30 facilitate securing apparatus 10 to a pair of vertical posts allowing rotation laterally thereabout.

Referring now to FIG. 3, there is shown a detailed cross sectional view taken along line 3—3 in FIG. 1, illustrating a solid state light assembly 40 secured to rear heatsink 20 in such an arrangement as to facilitate the transfer of heat generated by light assembly 40 to heatsink 20 for the dissipation of heat to the ambient via heatsink 20.

Solid state light assembly 40 is seen to comprise an array of light emitting diodes (LEDs) 42 aligned in a matrix, preferably comprising an 8×8 array of LEDs each capable of generating a light output of 1–3 lumens. However, limitation to the number of LEDs or the light output of each is not to be inferred. Each LED 42 is directly bonded to heatsink 20 within a respective light reflector comprising a recess defined therein. Each LED 42 is hermetically sealed by a glass material sealingly diffused at a low temperature over the LED die 42 and the wire bond thereto, such as 8000 Angstroms of, $SiO_2$ or $Si_3N_4$ material diffused using a semiconductor process. The technical advantages of this glass to metal hermetic seal over plastic/epoxy seals is significantly a longer LED life due to protecting the LED die from oxygen, humidity and other contaminants. If desired, for more light output, multiple LED dies 42 can be disposed in one reflector recess. Each LED 42 is directly secured to, and in thermal contact arrangement with, heatsink 20, whereby each LED is able to thermally dissipate heat via the bottom surface of the LED. Interfaced between the planar rear surface of each LED 42 is a thin layer of heat conductive material 46, such as a thin layer of epoxy or other suitable heat conductive material insuring that the entire rear surface of each LED 42 is in good thermal contact with rear heatsink 20 to efficiently thermally dissipate the heat generated by the LEDs. Each LED connected electrically in parallel has its cathode electrically coupled to the heatsink 20, and its Anode coupled to drive circuitry disposed on daughterboard 60. Alternatively, if each LED is electrically connected in series, the heatsink 20 preferably is comprised of an electrically non-conductive material such as ceramic.

Further shown in FIG. 3 is a main circuit board 48 secured to the front surface of heatsink 20, and having a central opening for allowing LED to pass generated light therethrough. LED holder 44 mates to the main circuit board 48 above and around the LED's 42, and supports a lens 86 above each LED. Also shown is a light diffuser 50 secured above the LEDs 42 by a plurality of standoffs 52, and having a rear curved surface 54 spaced from and disposed above the LED solid state light source 40, as shown. Each lens 86 (FIG. 9) is adapted to ensure each LED 42 generates light which impinges the rear surface 54 having the same surface area. Specifically, the lenses 86 at the center of the LED array have smaller radius of curvature than the lenses 86 covering the peripheral LEDs 42. The diffusing lenses 46 ensure each LED illuminates the same surface area of light diffuser 50, thereby providing a homogeneous (uniform) light beam of constant intensity.

A daughter circuit board 60 is secured to one end of heatsink 20 and main circuit board 48 by a plurality of standoffs 62, as shown. At the other end thereof is a power supply 70 secured to the main circuit board 48 and adapted to provide the required drive current and drive voltage to the LEDs 42 comprising solid state light source 40, as well as electronic circuitry disposed on daughterboard 60, as will be discussed shortly in regards to the schematic diagram shown in FIG. 16. Light diffuser 50 uniformly diffuses light generated from LEDs 42 of solid state light source 40 to produce a homogeneous light beam directed toward window 16.

Window 16 is seen to comprise a lens 70, and a Fresnel lens 72 in direct contact with lens 70 and interposed between lens 70 and the interior of housing 12 and facing light diffuser 50 and solid state light source 40. Lid 14 is seen to have a collar defining a shoulder 76 securely engaging and holding both of the round lens 70 and 72, as shown, and transparent sheet 73 having defined thereon grid 74 as will be discussed further shortly. One of the lenses 70 or 72 are colored to produce a desired color used to control traffic including green, yellow, red, white and orange.

It has been found that with the external heatsink being exposed to the outside air the outside heatsink 20 cools the LED die temperature up to 50° C. over a device not having a external heatsink. This is especially advantageous when the sun setting to the west late in the afternoon such as at an elevation of 10° or less, when the solar radiation directed in to the lenses and LEDs significantly increasing the operating temperature of the LED die for westerly facing signals. The external heatsink 20 prevents extreme internal operating air and die temperatures and prevents thermal runaway of the electronics therein.

Figure 4:
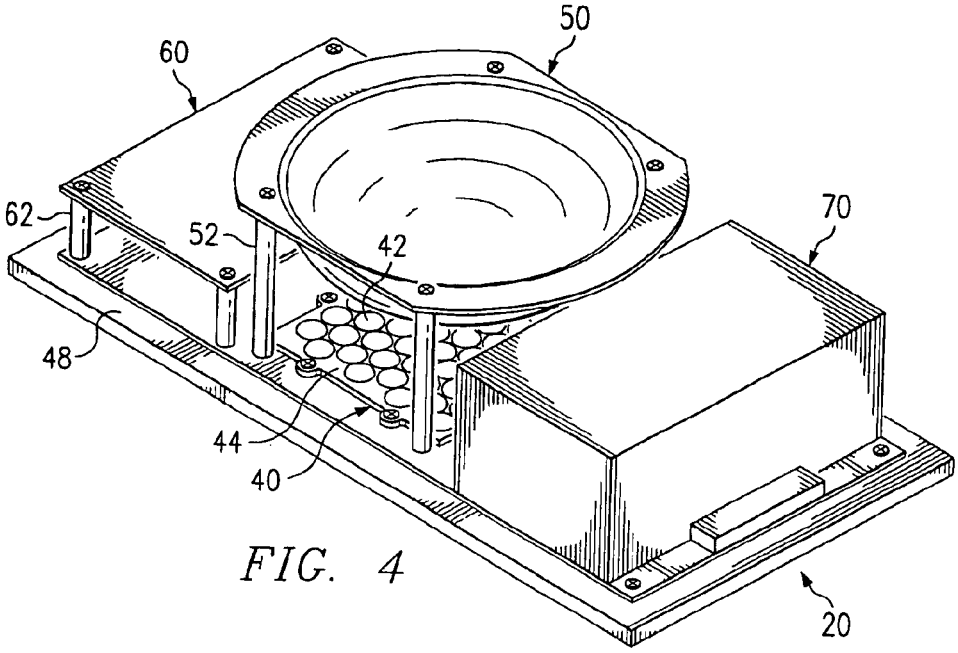
FIG. 4 is a perspective view of the electronic and optical assembly comprising the LED array, lense holder, light diffuser, power supply, main motherboard and daughterboard.

Referring now to FIG. 4, there is shown the electronic and optic assembly comprising of solid state light source 40, light diffuser 50, main circuit board 48, daughter board 60, and power supply 70. As illustrated, the electronic circuitry on daughter board 60 is elevated above the main board 48, whereby standoffs 62 are comprised of thermally nonconductive material.

Figure 5:
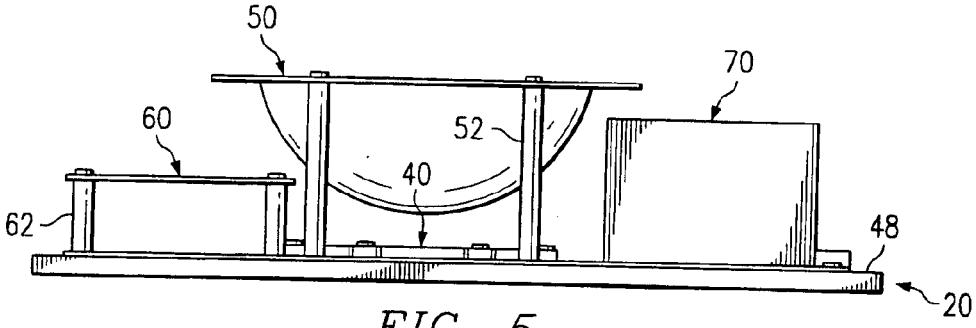
FIG. 5 is a side view of the assembly of FIG. 4 illustrating the array of LEDs being directly mounted to the heatsink, below respective lenses and disposed beneath a light diffuser, the heatsink for terminally dissipating generated heat.

Referring to FIG. 5, there is shown a side view of the assembly of FIG. 4 illustrating the light diffuser 50 being axially centered and disposed above the solid state LED array 40. Diffuser 50, in combination with the varying diameter lenses 86, facilitates light generated from the LEDs 42 to be uniformly disbursed and have uniform intensity and directed upwardly as a light beam toward the lens 70 and 72, as shown in FIG. 3.

Figure 6:
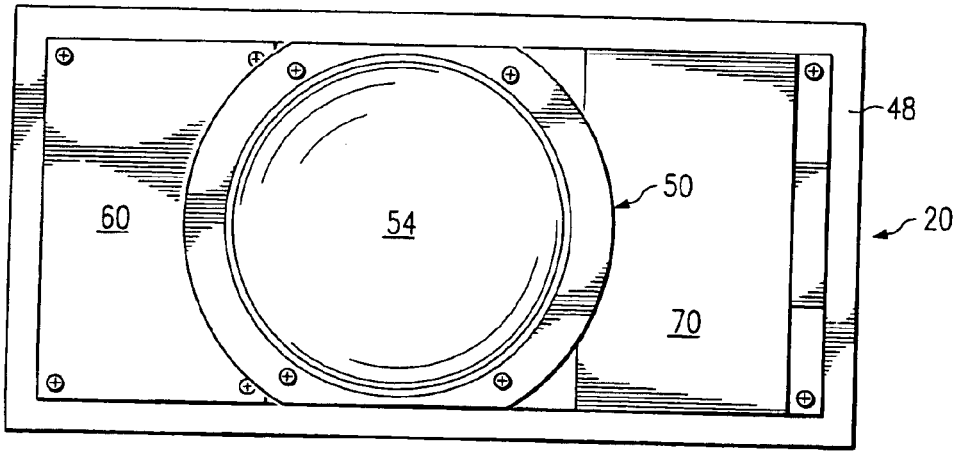
FIG. 6 is a top view of the electronics assembly of FIG. 4.

Referring now to FIG. 6, there is shown a top view of the assembly shown in FIG. 4, whereby FIG. 7 illustrates a side view of the same.

Referring now to FIG. 8, there is shown a top view of the lens holder 44 comprising a plurality of openings 80 each adapted to receive one of the LED lenses 86 hermetically sealed to and bonded thereover. Advantageously, the glass to metal hermetic seal has been found in this solid state light application to provide excellent thermal conductivity and hermetic sealing characteristics. Each opening 80 is shown to be defined in a tight pack arrangement about the plurality of LEDs 42. As previously mentioned, the lenses 86 at the center of the array, shown at 81, have a smaller curvature diameter than the lenses 86 over the perimeter LEDs 42 to increase light dispersion and ensure uniform light intensity impinging diffuser 50.

Referring to FIG. 9, there is shown a cross section taken alone line 9—9 in FIG. 8 illustrating each opening 80 having an annular shoulder 82 and a lateral sidewall 84 defined so that each cylindrical lens 86 is securely disposed within opening 80 above a respective LED 42. Each LED 42 is preferably mounted to heatsink 20 using a thermally conductive adhesive material such as epoxy to ensure there is no air gaps between the LED 42 and the heatsink 20. The present invention derives technical advantages by facilitating the efficient transfer of heat from LED 42 to the heatsink 20.

Referring now to FIG. 10, there is shown a top view of the main circuit board 48 having a plurality of openings 90 facilitating the attachment of standoffs 62 securing the daughter board above an end region 92. The power supply 48 is adapted to be secured above region 94 and secured via fasteners disposed through respective openings 96 at each corner thereof. Center region 98 is adapted to receive and have secured thereagainst in a thermal conductive relationship the LED holder 42 with the thermally conductive material 46 being disposed thereupon. The thermally conductive material preferably comprises of epoxy, having dimensions of, for instance, 0.05 inches. A large opening 99 facilitates the attachment of LED's 42 to the heatsink 20, and such that light from the LEDs 42 is directed to the light diffuser 50.

Referring now to FIG. 11, there is shown a side elevational view of diffuser 50 having a lower concave surface 54, preferably having a radius A of about 2.4 inches, with the overall diameter B of the diffuser including a flange 55 being about 6 inches. The depth of the rear surface 52 is about 1.85 inches as shown as dimension C.

Referring to FIG. 12, there is shown a top view of the diffuser 50 including the flange 56 and a plurality of openings 58 in the flange 56 for facilitating the attachment of standoffs 52 to and between diffuser 50 and the heatsink 20, shown in FIG. 4.

Referring now to FIG. 13 there is shown the Fresnel lens 72, preferably having a diameter D of about 12.2 inches. However, limitation to this dimension is not to be inferred, but rather, is shown for purposes of the preferred embodiment of the present invention. The Fresnel lens 72 has a predetermined thickness, preferably in the range of about 1/16 inches. This lens is typically fabricated by being cut from a commercially available Fresnel lens.

Referring now back to FIG. 1A and FIG. 1B, there is shown generally at 56 a video camera oriented to view forward of the front face of solid state lamp 10 and 30, respectively. The view of this video camera 56 is precisionaly aligned to view along and generally parallel to the central longitudinal axis shown at 58 that the beam of light generated by the internal LED array is oriented. Specifically, at large distances, such as greater than 20 feet, the video camera 56 generates an image having a center of the image generally aligned with the center of the light beam directed down the center axis 58. This allows the field technician to remotely electronically align the orientation of the light beam referencing this video image.

Figure 14A:
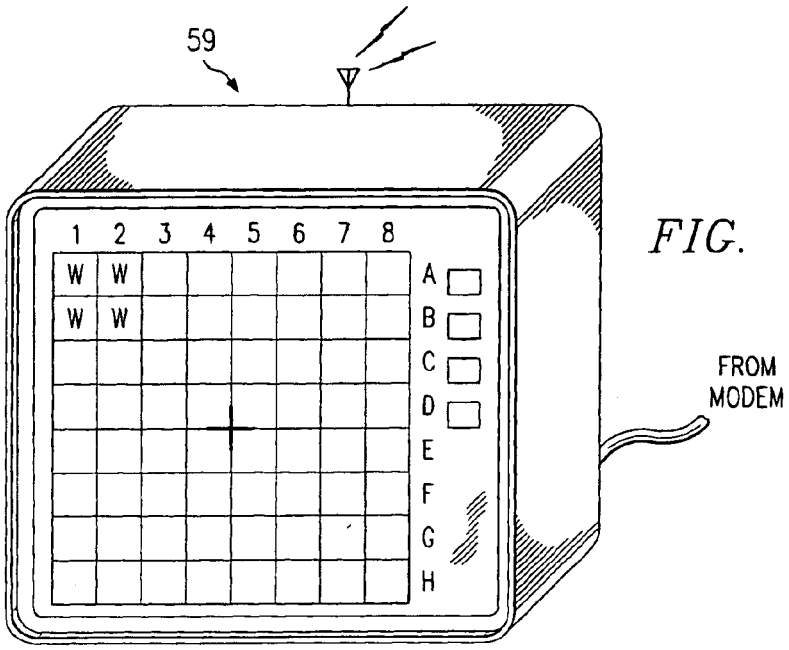
FIG. 14A is a view of a remote monitor displaying an image generated by a video camera in the light apparatus to facilitate electronic alignment of the LED light beam.

For instance, in one preferred embodiment the control electronics 60 has software generating and overlaying a grid along with the video image for display at a remote display terminal, such as a LCD or CRT display shown at 59 in FIG. 14A. This video image is transmitted electronically either by wire using a modem, or by wireless communication using a transmitter allowing the field technician on the ground to ascertain that portion of the road that is in the field of view of the generated light beam. By referencing this displayed image, the field technician can program which LEDs 42 should be electronically turned on, with the other LEDs 42 remaining off, such that the generated light beam will be focused by the associated optics including the Fresnel lens 72, to the proper lane of traffic. Thus, on the ground, the field technician can electronically direct the generated light beam from the LED arrays, by referencing the video image, to the proper location on the ground without mechanical adjustment at the light source, such as by an operator situated in a DOT bucket. For instance, if it is intended that the objects viewable and associated with the upper four windows defined by the grid should be illuminated, such as those objects viewable through the windows labeled as W in FIG. 14A, the LEDs 42 associated with the respective windows "W" will be turned on, with the rest of the LEDs 46 associated with the other windows being turned off. Preferably, there is one LED 46 associated with each window defined by the grid. Alternatively, a transparent sheet 73 having a grid 74 defining windows 78 can be laid over the display surface of the remote monitor 59 whereby each window 78 corresponds with one LED. For instance, there may be 64 windows associated with the 64 LEDs of the LED array. Individual control of the respective LEDs is discussed hereafter in reference to FIG. 14A. The video camera 56, such as a CCD camera or a CMOS camera, is physically aligned alone the central axis 58, such that at extended distances the viewing area of the camera 56 is generally along the axis 58 and thus is optically aligned with regards to the normal axis 58 for purposes of optical alignment.

Figure 14B:
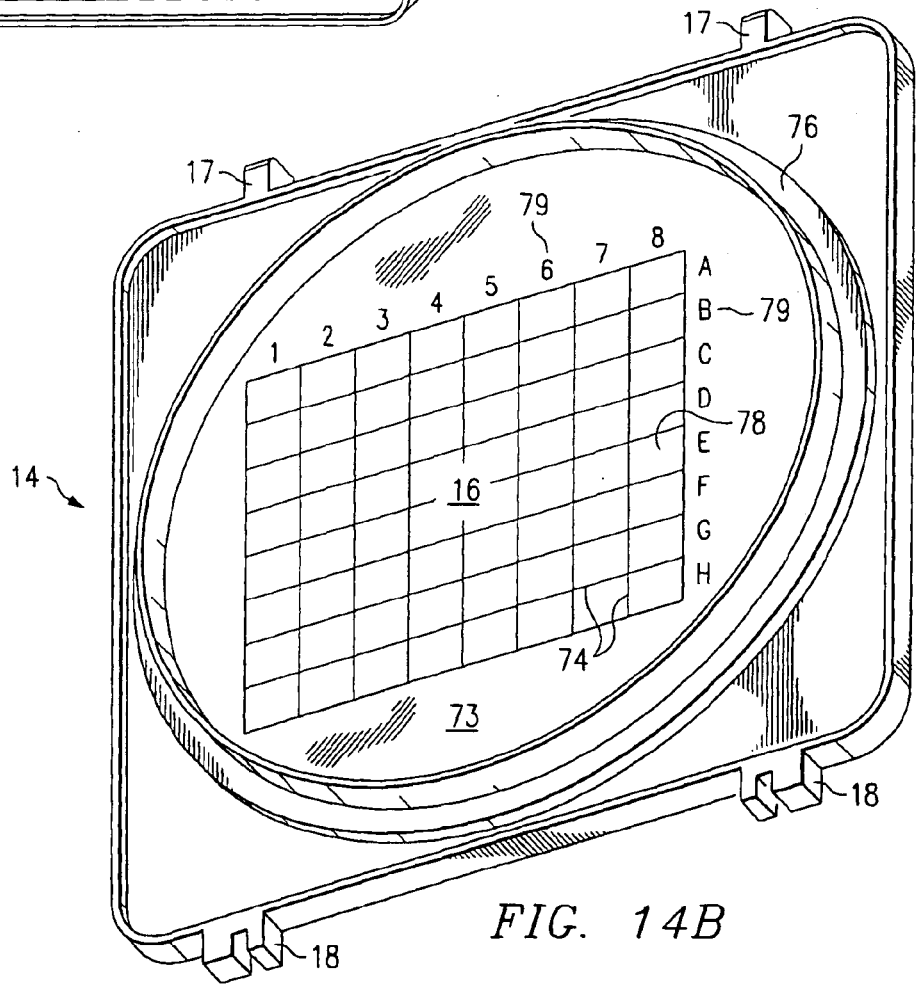
FIG. 14B is a perspective view of the lid of the apparatus shown in FIG. 1 having a grid overlay for use with the optical alignment system.

Referring now to FIG. 14B, there is illustrated the lid 14, the hinge members 17, and the respective latches 18. Holder 14 is seen to further have an annular flange member 70 defining a side wall about window 16, as shown. Further shown the transparent sheet 73 and grid 74 comprising of thin line markings defined over openings 16 defining windows 78. The sheet can be selectively placed over window 16 for alignment, and which is removable therefrom after alignment. Each window 78 is precisionaly aligned with and corresponds to one sixty four (64) LEDs 42. Indicia 79 is provided to label the windows 78, with the column markings preferably being alphanumeric, and the columns being numeric. The windows 78 are viable through optical sight member 28, via an opening in heatsink 20. The objects viewed in each window 78 are illuminated substantially by the respective LED 42, allowing a technician to precisionaly orient the apparatus 10 so that the desired LEDs 42 are oriented to direct light along a desired path and be viewed in a desired traffic lane. The sight member 28 may be provided with cross hairs to provide increased resolution in combination with the grid 74 for alignment.

Moreover, electronic circuitry 100 on daughterboard 60 can drive only selected LEDs 42 or selected 4×4 portions of array 40, such as a total of 16 LED's 42 being driven at any one time. Since different LED's have lenses 86 with different radius of curvature different thicknesses, or even comprised of different materials, the overall light beam can be electronically steered in about a 15° cone of light relative to a central axis defined by window 16 and normal to the array center axis.

For instance, driving the lower left 4×4 array of LEDs 42, with the other LEDs off, in combination with the diffuser 50 and lens 70 and 72, creates a light beam +7.5 degrees above a horizontal axis normal to the center of the 8×8 array of LEDs 42, and +7.5 degrees right of a vertical axis. Likewise, driving the upper right 4×4 array of LEDs 42 would create a light beam +10 degrees off the horizontal axis and +7.5 degrees to the right of a normalized vertical axis and −7.5 degrees below a vertical axis. The radius of curvature of the center lenses 86 may be, for instance, half that of the peripheral lenses 86. A beam steerable +/−7.5 degrees in 1–2 degree increments is selectable. This feature is particularly useful when masking the opening 16, such as to create a turn arrow. This further reduces ghosting or roll-off, which is stray light being directed in an unintended direction and viewable from an unintended traffic lane.

The electronically controlled LED array provides several technical advantages including no light is blocked, but rather is electronically steered to control a beam direction. Low power LEDs are used, whereby the small number of the LEDs "on" (i.e. 4 of 64) consume a total power about 1–2 watts, as opposed to an incandescent prior art bulb consuming 150 watts or a flood 15 watt LED which are masked or lowered. The present invention reduces power and heat generated thereby.

Figure 15:
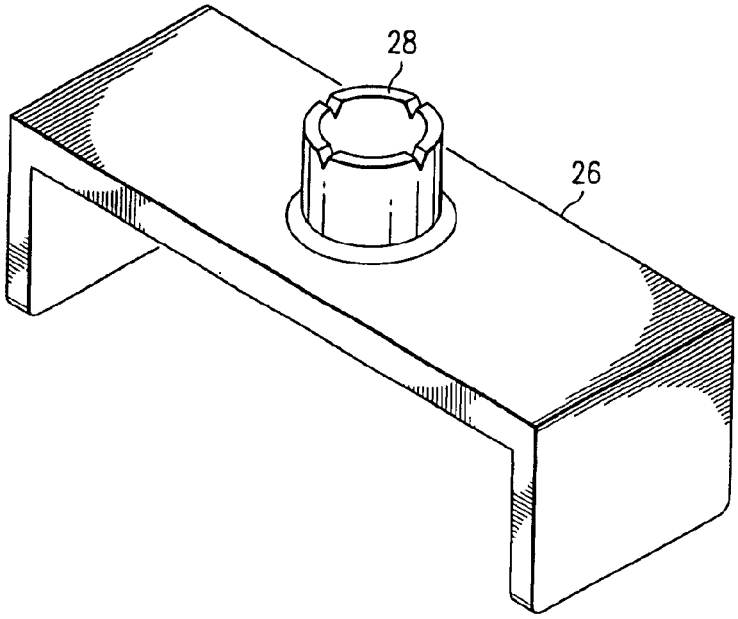
FIG. 15 is a perspective view of the optical alignment system eye piece adapted to connect to the rear of the light unit shown in FIG. 1.

Referring now to FIG. 15, there is shown a perspective view of the eye piece 26 as well as the optical sight member 28, as shown in FIG. 1, the center axis of optical sight member 28 is oriented along the center of the 8×8 LED array.

Figure 16A:
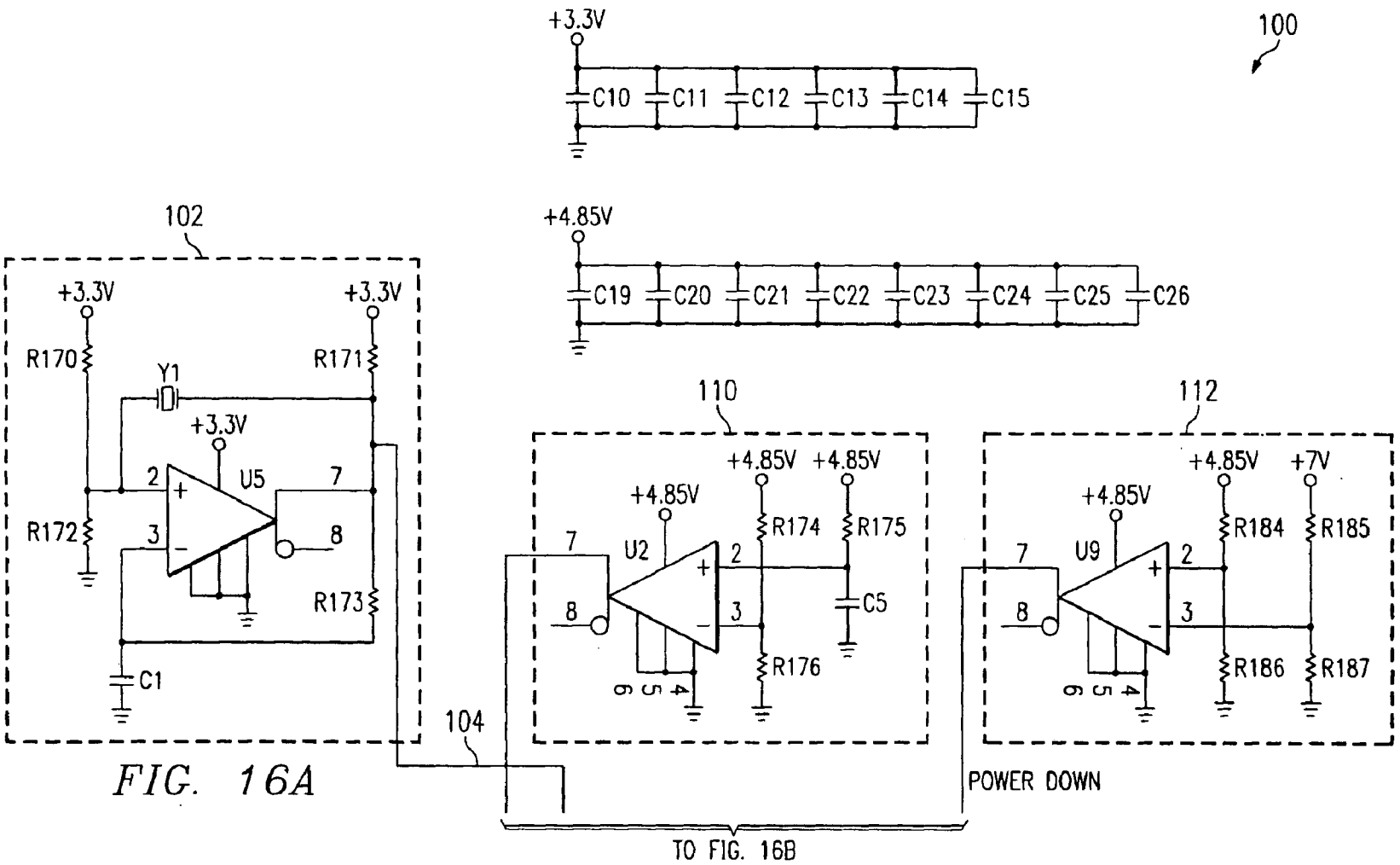
FIGS. 16A–F is a schematic diagram of the control circuitry disposed on the daughterboard and incorporating various features of the invention including control logic, as well as light detectors for sensing ambient light and reflected generated light from the light diffuser used to determine and control the light output from the solid state light.

Referring now to FIG. 16A, there is shown at 100 a schematic diagram of the circuitry controlling light apparatus 10. Circuit 10 is formed on the daughterboard 60, and is electrically connected to the LED solid state light source 40, and selectively drives each of the individual LEDs 42 comprising the array. Depicted in FIG. 16A is a complex programmable logic device (CPLD) shown as U1. CPLD U1 is preferably an off-the-shelf component such as provided by Maxim Corporation, however, limitation to this specific part is not to be inferred. For instance, discrete logic could be provided in place of CPLD U1 to provide the functions as is described here, with it being understood that a CPLD is the preferred embodiment is of the present invention. CPLD U1 has a plurality of interface pins, and this embodiment, shown to have a total of 144 connection pins. Each of these pin are numbered and shown to be connected to the respective circuitry as will now be described.

Shown generally at 102 is a clock circuit providing a clock signal on line 104 to pin 125 of the CPLD U1. Preferably, this clock signal is a square wave provided at a frequency of 32.768 KHz. Clock circuit 102 is seen to include a crystal oscillator 106 coupled to an operational amplifier U5 and includes associated trim components including capacitors and resistors, and is seen to be connected to a first power supply having a voltage of about 3.3 volts.

Still referring to FIG. 16A, there is shown at 110 a power-up clear circuit comprised of an operational amplifier shown at U2 preferably having the non-inverting output coupled to pin 127 of CPLD U1. The inverting input is seen to be coupled between a pair of resistors, R174 and R176, providing a voltage divide circuit, providing approximately a 2.425 volt reference signal when based on a power supply of 4.85 volts being provided to the positive rail of the voltage divide network. The non-inverting input is preferably coupled to the 4.85 voltage reference via a current limiting resistor R175, as shown. Upon power up, the voltage at the non-inverting input will come up slower than the voltage at the inverting input due to the slower rise time induced by capacitor C5. The voltage at the non-inverting input will rise, and will eventually exceed the voltage at the inverting input after the 4.85V power supply has stabilized and comparator U2 responsively generate a logic 1 to Pin 127 of U1 to indicate a stable power supply.

As shown at 112, an operational amplifier U6 is shown to have its non-inverting output connected to pin 109 of CPLD U1. Operational amplifier U9 provides a power down function.

Referring now to ambient light detection circuit 120, there is shown circuitry detecting ambient light intensity and comprising of at least one photodiode identified as PD1, although more than one spaced photodiode PD1 could be provided. An operational amplifier depicted as U10 is seen to have its non-inverting output coupled to input pin 100 of CPLD U1. The non-inverting input of amplifier U10 is connected to the anode of photodiode PD1, which photodiode has its cathode connected to the second power supply having a voltage of about 4.85 volts. The non-inverting input of amplifier U10 is also connected via a current via a current limiting resistor to ground. The inverting reference input of amplifier U10 is coupled to input 99 and 101 of CPLD U1 via a voltage divide network and comparators U8 and U9. A second comparator U11 has a non-inverting input also coupled to the anode of photodiode PD1, and the inverting reference input connected the resistive voltage divide network. Both comparators U10 and U11 determines if the DC voltage generated by the photodiode PD1, which is indicative of the sensed ambient light intensity, exceeds a respective different voltage threshold provided to the respective inverting input. A lower reference threshold voltage is provided to comparator U11 then the reference threshold voltage provided to comparator U10 to provide a second ambient light intensity threshold detection.

Referring now to the beam intensity detection circuit 122 including a comparator U7 and an optical feedback circuit 123, these components will now be discussed in detail. The beam intensity circuit 122 detects the intensity of backscattered light from Fresnel lens 72, as shown at 124 in FIG. 3, whereby the intensity of the sensed backscattered light is indicative of the beam intensity generated by the solid state apparatus 10 and 40. That is, the intensity of a sensed backscattered light 124 is directive proportional to the intensity of the light beam generated by apparatus 10 and 40 and is proportional thereto.

Referring to FIG. 16A, comparator U7 has its inverting reference input coupled to pin 86 of CPLD U1 and is provided with a DC reference voltage therefrom. This reference DC voltage establishes the nominal voltage for comparison against the DC feedback voltage provided by the optical feedback circuit 123 at node F as will now be described in considerable detail.

Figure 16B:
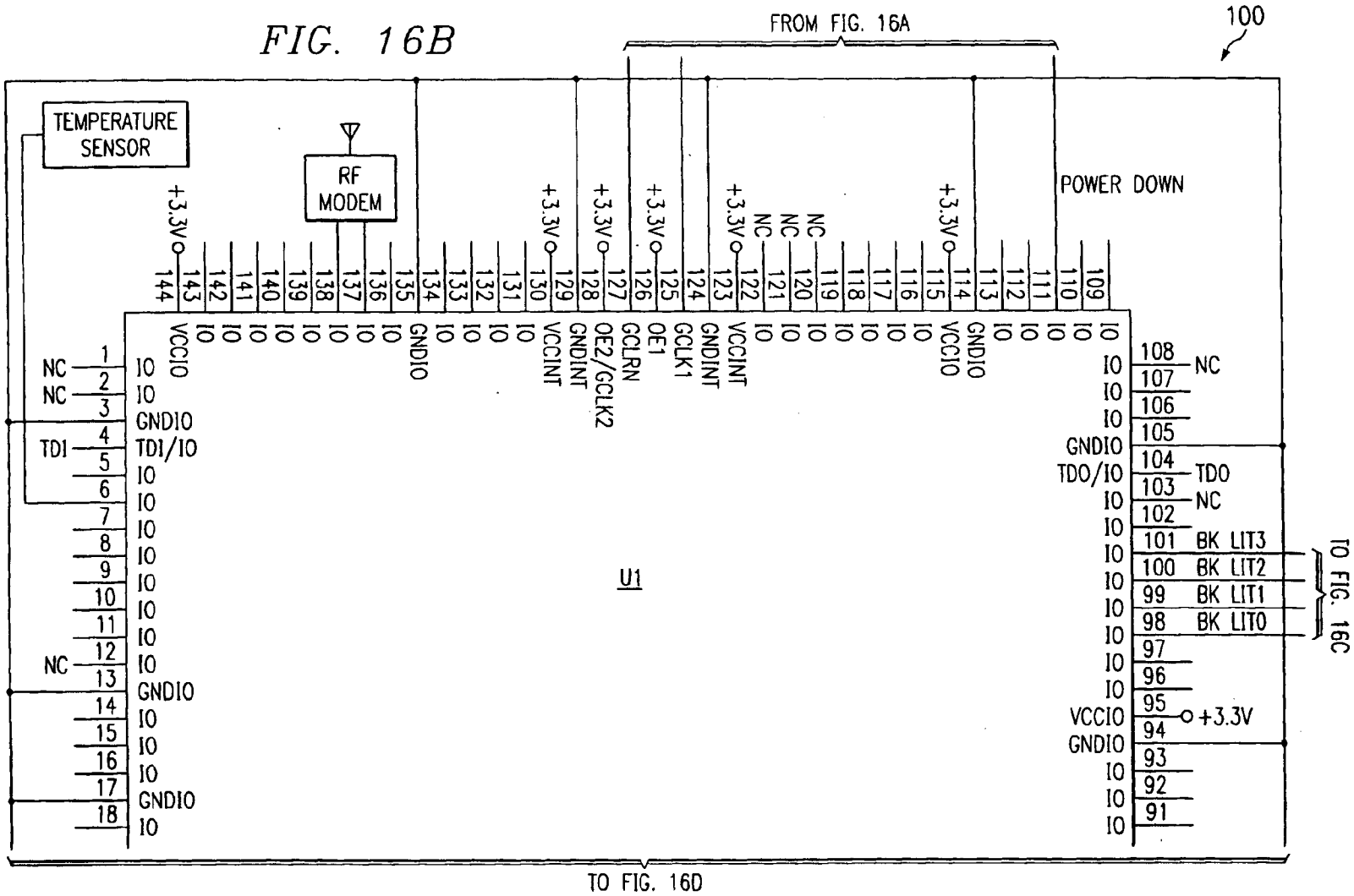

Referring to FIG. 16B, there is illustrated the optical feedback circuit 123 comprising a plurality of photodiode's PD2 seen to all be connected in parallel between a 4.85 volt source and a summation node 125. This summation node 125 is coupled via a large resistor to ground, as shown. Both the ambient light, and the pulsed backscattered from the Fresnel lens, are detected by these plurality of photodiode's PD2 which generate a respective DC and AC voltage component as a function of the respective intensity of light directed thereupon. For instance, the ambient light from external solid state light apparatus 10 and 40 is transmitted through the Fresnel lens to the photodiode's PD2. These photodiode's PD2 generate a corresponding DC voltage that is proportional the intensity of the ambient light impinging thereupon. In addition, the backscattered pulsed light generated by the LED's 42 onto the photodiode's PD2 induces an AC voltage component that is proportional to the intensity of the sensed pulsed backscattered light. Since the light generated by the LED array comprising LED's 42 is pulsed with modulated at about 1 kilohertz, this AC voltage component has the same frequency of about 1 kilohertz. Both the AC and DC voltage components generated by the plurality of photodiode's PD2 are summed at summation node 125. Series capacitor C18 provides capacitive coupling between this summation node 125 and the inverting input of single ended amplifier U20 to pass on to the AC voltage component to the inverting input of amplifier U20, which AC voltage corresponds to the pulsed light generated by the LED array. Thus, at the inverting input of amplifier U20, the magnitude of the AC voltage component is directly proportional to and indicative of the intensity of pulsed light sensed by the photodiode's PD2 and backscattered from the Fresnel lens 72. Amplifier U20 has its non-inverting input tied to ground, as shown. Amplifier U20 provides a gain of roughly 1,000 as determined by the ratio of resistors R2 and R1, whereby the gain equals R2/R1.

The inverting output of amplifier U20 is connected via a large series capacitor C30 to a node A. This node A is connected via a resistor R100 to a feedback node F as well as to the emitter of NPN transistor Q1. A larger capacitor C31 tied between the feedback node F and ground is substantially smaller than the capacitor C30, whereby resistor R100 and capacitor C31 provide an integrator function and operate as a low pass RC filter. The RC integrator comprised of R100 and capacitor C31 integrate the AC voltage at node A to provide a DC voltage at node F that is a function of both the duty cycle of the pulsed PWM AC voltage at node A as well as the amplitude of the pulsed PWM AC voltage at node A. Transistor Q1 in combination with resistor 200 and diode D3 maintain node A close to ground at one condition while allowing a variable high level signal.

By way of example, if the plurality of photodiode's PD2 sense incident pulsed light backscattered from Fresnel lens 72 at a first intensity and provide at summation node 125 a 1 millivolt peak-to-peak signal having a 50% duty cycle, amplifier U20 will provide a 0.5 volt peak-to-peak 50% duty cycle signal at its inverting output, which AC signal is integrated by resistor 100 and C31 to provide a 0.5 volt DC signal at feedback node F. For night operation, this 0.5 volt DC signal at feedback node F may correspond to the nominal intensity of the light beam generated by apparatus 10 and 40.

During day operation, it may be desired that the beam intensity generated by apparatus 10 and 40 produce backscattered light to photodiode's PD2 to be a 90% duty cycle signal introducing a 4 millivolt peak-to-peak AC voltage signal at summation node 125. Amplifier U20 will provide a gain of 1000 to this signal to provide a 4 volt peak to peak AC voltage at its inverting output which when integrated by the integrator R100 and capacitor C31 at a 90% duty cycle will yield a 3.6 volt DC signal at feedback node F.

Now, in the case when the intensity of the light output from apparatus 10 and 40 falls 10% from that minimum beam intensity required for night operation, a corresponding 0.9 millivolt peak-to-peak AC signal having a 50% duty cycle will be generated a summation node 125, thereby providing a 0.9 volt peak-to-peak AC signal at the output of amplifier U20, and a 0.45 volt DC signal at the feedback node F. This 0.45 volt DC signal provided at the feedback node F is provided back to the non-inverting input of comparator U7 in FIG. 16A, and when sensed against the reference voltage provided to the inverting input of comparator U7 will generate a logic 1 signal on the non-inverting output thereof to Pin 79 of CPLD U1. The CPLD U1 using the algorithm, shown in FIG. 17, will thereby increase the duty cycle or the drive current to the LED array, thereby correspondingly increasing the duty cycle or current of the backscattered light sensed by photodiode's PD2. The detecting circuit 123 will responsively sense via the backscattered light of the increased light output of the apparatus 10 and 40 and sense the corresponding increase in the backscattered light. For instance, in the case where the beam intensity of the apparatus 10 and 40 fell 10% below the minimum intensity required by the DOT, the duty cycle of the drive voltage for the LED array may be increased 10% to a 55% duty cycle, such that the optical feedback circuit 123 will again provide a 0.5 volt DC signal at feedback node F which is sensed by comparator U10 thereby informing CPLD U1 that the beam light intensity output from apparatus 10 and 40 again meets the DOT minimum requirements.

In likewise operation, CPLD U1 will reduce the duty cycle or the drive current to the LED array slightly until the generated DC voltage signal at feedback node F is sensed by comparator U10 to fall below the reference voltage provided to the inverting input thereof. In this way, CPLD U1 responsively adjusts the duty cycle or drive current of the voltage signal driving the LED array such that the DC voltage provided at the feedback node F is slightly above the reference voltage provided to the inverting input of comparator U10.

Light apparatus 10 and 40 to present invention is adapted to provide different beam intensities depending on the ambient light that the traffic signal is operating in, which ambient light intensity is determined by photodiode's PD1 and circuit 120 as previously described. If CPLD U1 determines via circuit 120 day operation with high intensity ambient light beam sensed by photodiode PD1, the reference voltage provided to the inverting input of comparator U10 is increased to a second pre-determined threshold. CPLD U1 will provide a drive signal to transistor Q35 and LED drive circuit 130 with a sufficient duty cycle and drive current, increasing the beam intensity of the apparatus 10 and 40 until the feedback circuit 123 generates a DC voltage at feedback node F as sensed by comparator U10 corresponding to a reference voltage at the inverting input thereof.

Likewise, when the ambient detection photodiode PD1 and circuit 120 determines night operation, or maybe operation during a storm creating darker ambient light conditions, CPLD U1 will provide a second predetermined DC voltage reference to the inverting input of comparator U10. CPLD U1 reduces the duty cycle or drive current of the drive signal to LED circuit 130 until optical feedback circuit 123 is determined by comparator U10 to generate a DC voltage at node F corresponding to this reduced voltage reference signal corresponding to a darkened operation.

The optical feedback circuit 123 derives advantages in that backscattered light is sensed indicative of the pulsed generated light from the apparatus 10 and 40 to directly provide an indication of a generated light intensity therefrom. A plurality of photodiode's PD2 are provided in parallel having their outputs summed at summation node 125, whereby degradation or failure of one photodiode PD2 does not significantly effect the accuracy of the detection circuit. The optical feedback circuit 123 provides a DC voltage at feedback node F that directly corresponds to the sensed pulsed light, and which is not effected by the ambient light since the DC component generated by the photodiode's PD2 due to ambient light is filtered out. In this way, the optical feedback circuit 123 comprising detection circuit 122 accurately senses intensity of the pulsed light beam from the apparatus 10 and 40. CPLD U1 always insures an adequate and appropriate beam intensity is generated by apparatus 10 and 40 without overdriving the LED array, and while always meeting DOT requirements.

Figure 16C:
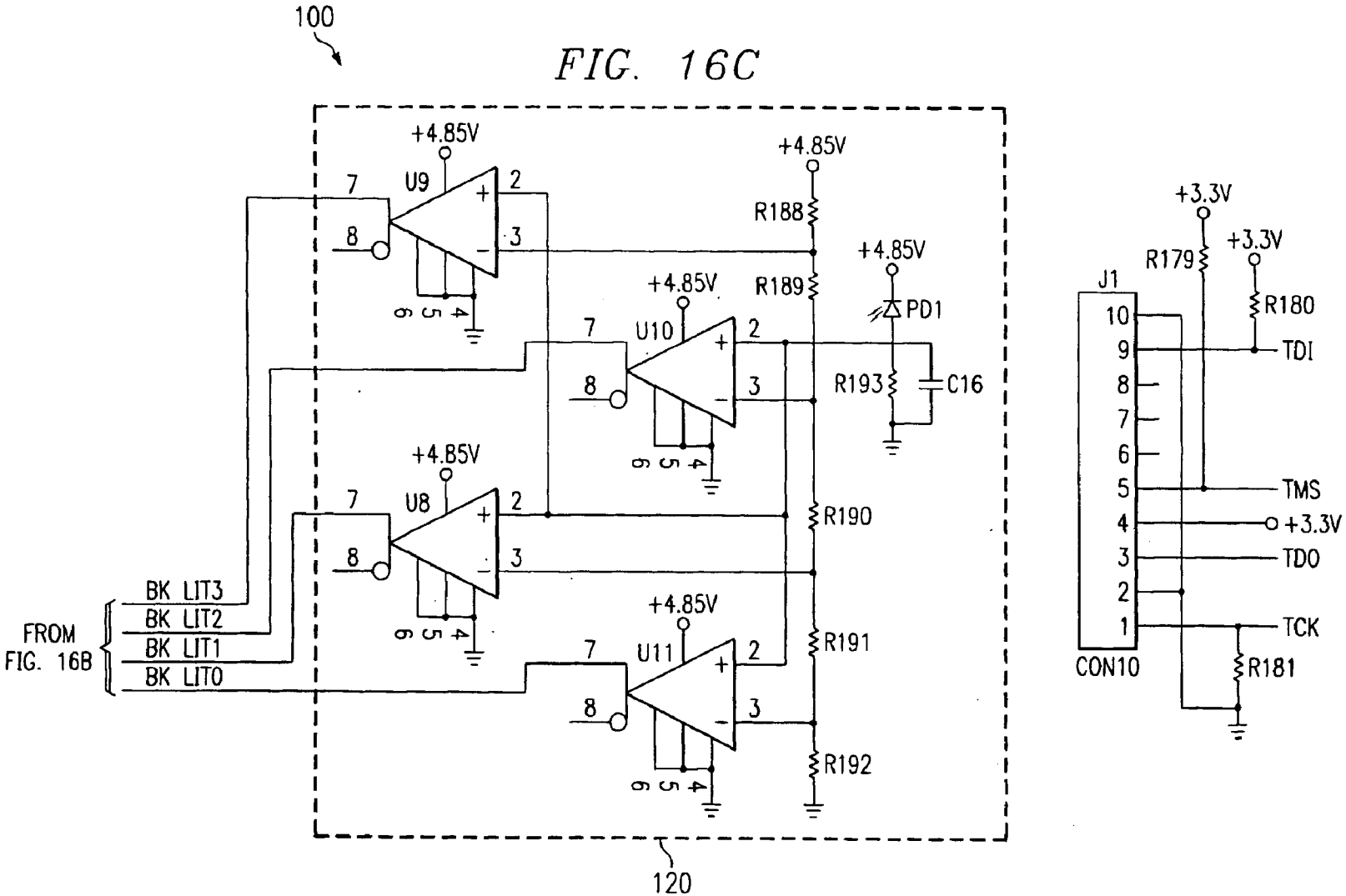

An LED drive circuit is shown at 130 serially interfaces LED drive signal data to drive circuitry of the LEDs 42 as shown in FIG. 16C.

Shown at 140 is another connector adapted to interface control signals from CPLD U1 to an initiation control circuit for the LED's 42.

Each of the LEDs 42 is individually controlled by CPLD U1 whereby the intensity of each LED 42 is controlled by the CPLD U1 selectively controlling a drive current thereto, a drive voltage, or adjusting a duty cycle of a pulse width modulation (PWM) drive signal, and as a function of sensed optical feedback signals derived from the photodiodes as will now be described in reference to FIG. 17.

Figure 17:
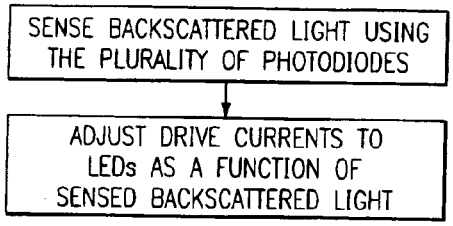
FIG. 17 is an algorithm depicting the sensing of ambient light and backscattered light to selectably provide a constant output of light.

Referring to FIG. 17 in view of FIG. 3, there is illustrated how light generated by solid state LED array 40 is diffused by diffuser 50, and a small portion 124 of which is back-scattered by the inner surface of Fresnel lens 72 back toward the surface of daughter board 60. The back-scattered diffused light 124 is sensed by photodiodes PD2, shown in FIG. 16. The intensity of this back-scattered light 124 is measured by circuit 122 and provided to CPLD U1. CPLD U1 measures the intensity of the ambient light via circuit 120 using photodiode PD1. The light generated by LED's 42 is preferably distinguished by CPLD U1 by strobing the LEDs 42 using pulse width modulation (PWM) such as at a frequency of 1KH2 to discern light generated by LEDs 42 from the ambient light (not pulsed).

Figure 16D:
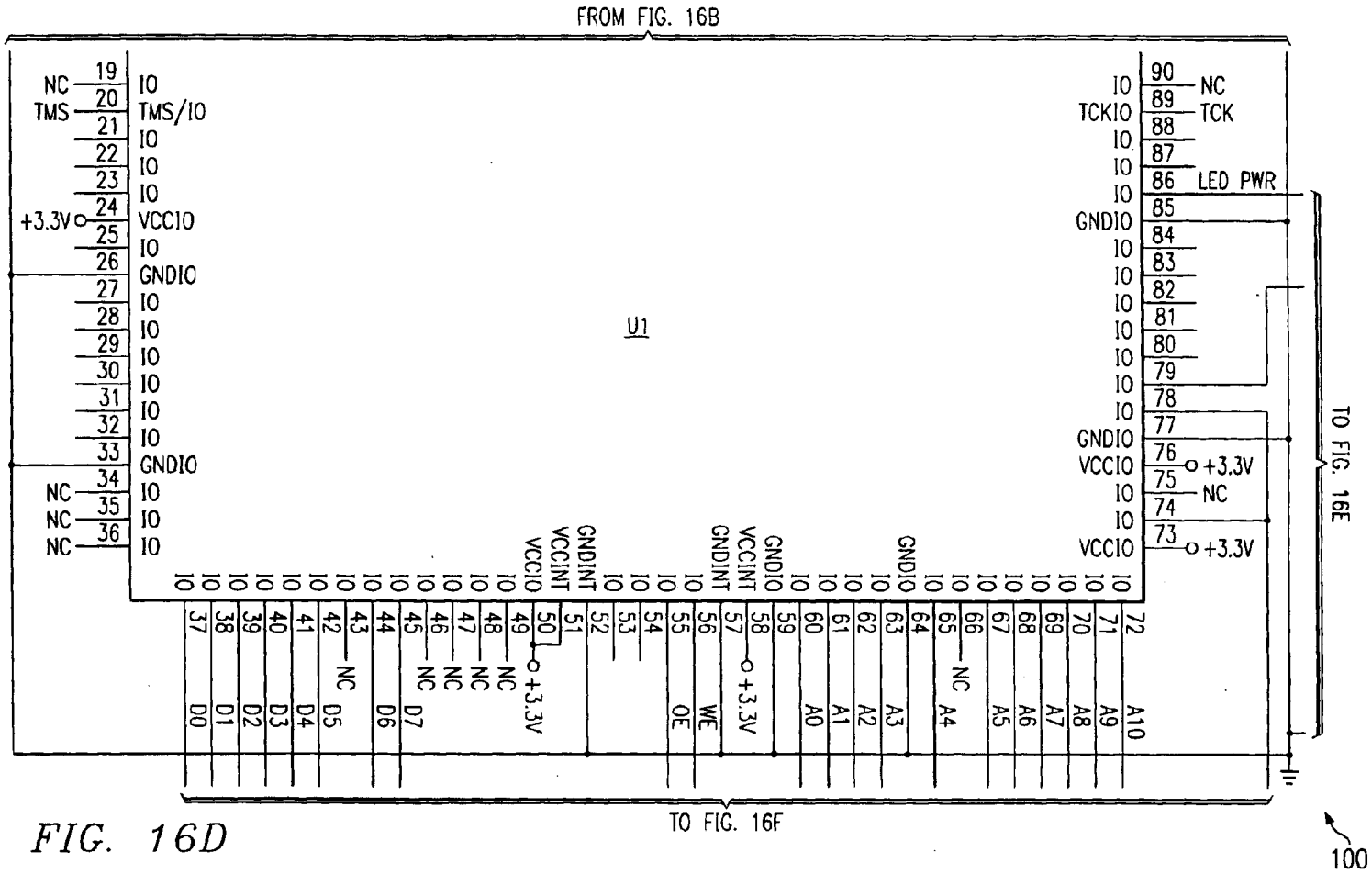

CPLD U1 individually controls the drive current, drive voltage, and PWM duty cycle to each of the respective LEDs 42 as a function of the light detected by circuits 120 and 122 as shown in FIG. 16D. For instance, it is expected that between 3 and 4% of the light generated by LED array 40 will back-scatter back from the Fresnel lens 72 toward to the circuitry 100 disposed on daughterboard 60 for detection. By normalizing the expected reflected light to be detected by photodiodes PD2 in circuit 122, for a given intensity of light to be emitted by LED array 40 through window 16 of lid 14, optical feedback is used to ensure an appropriate light output, and a constant light output from apparatus 10.

Figure 16E:
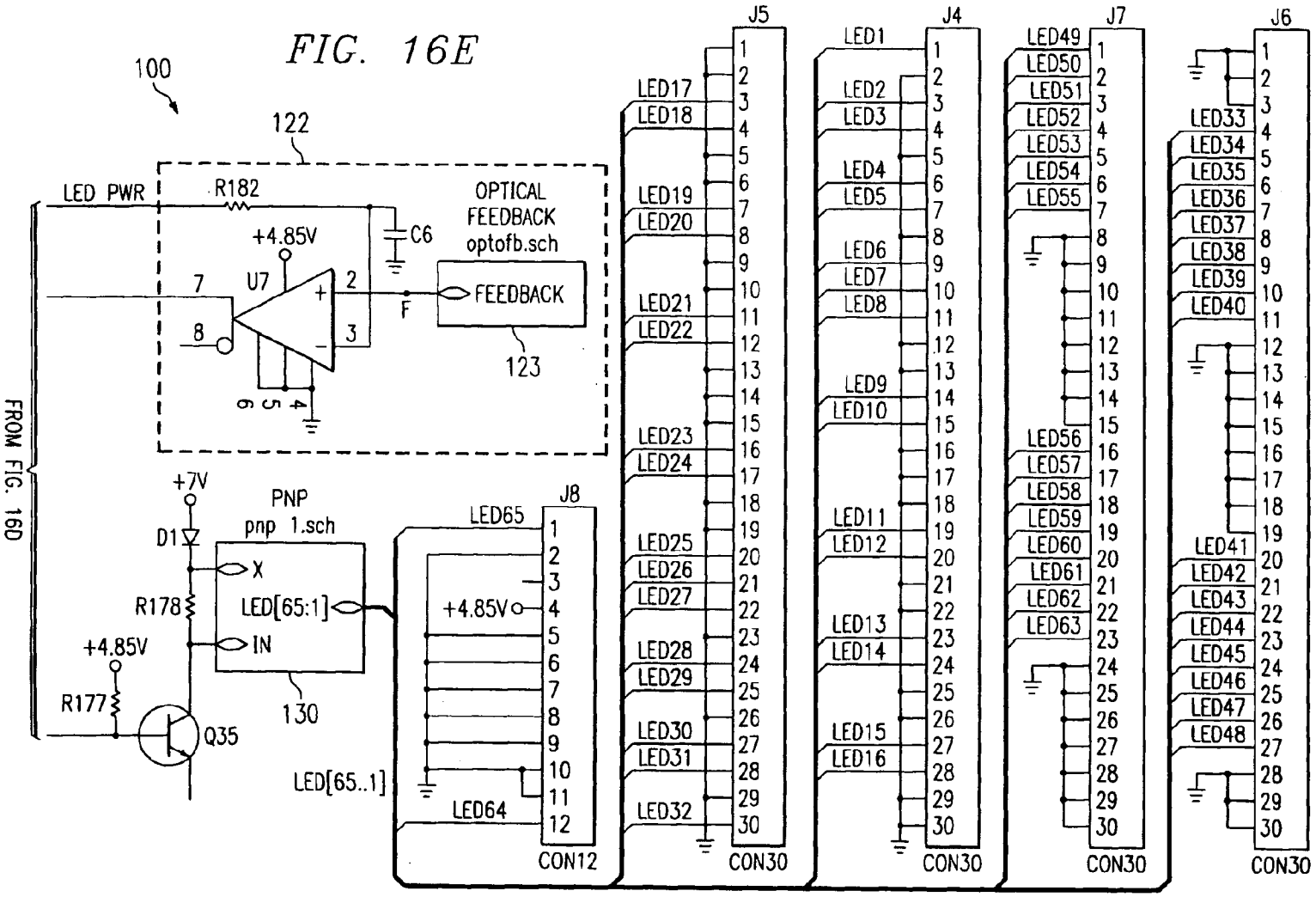
Figure 16F:
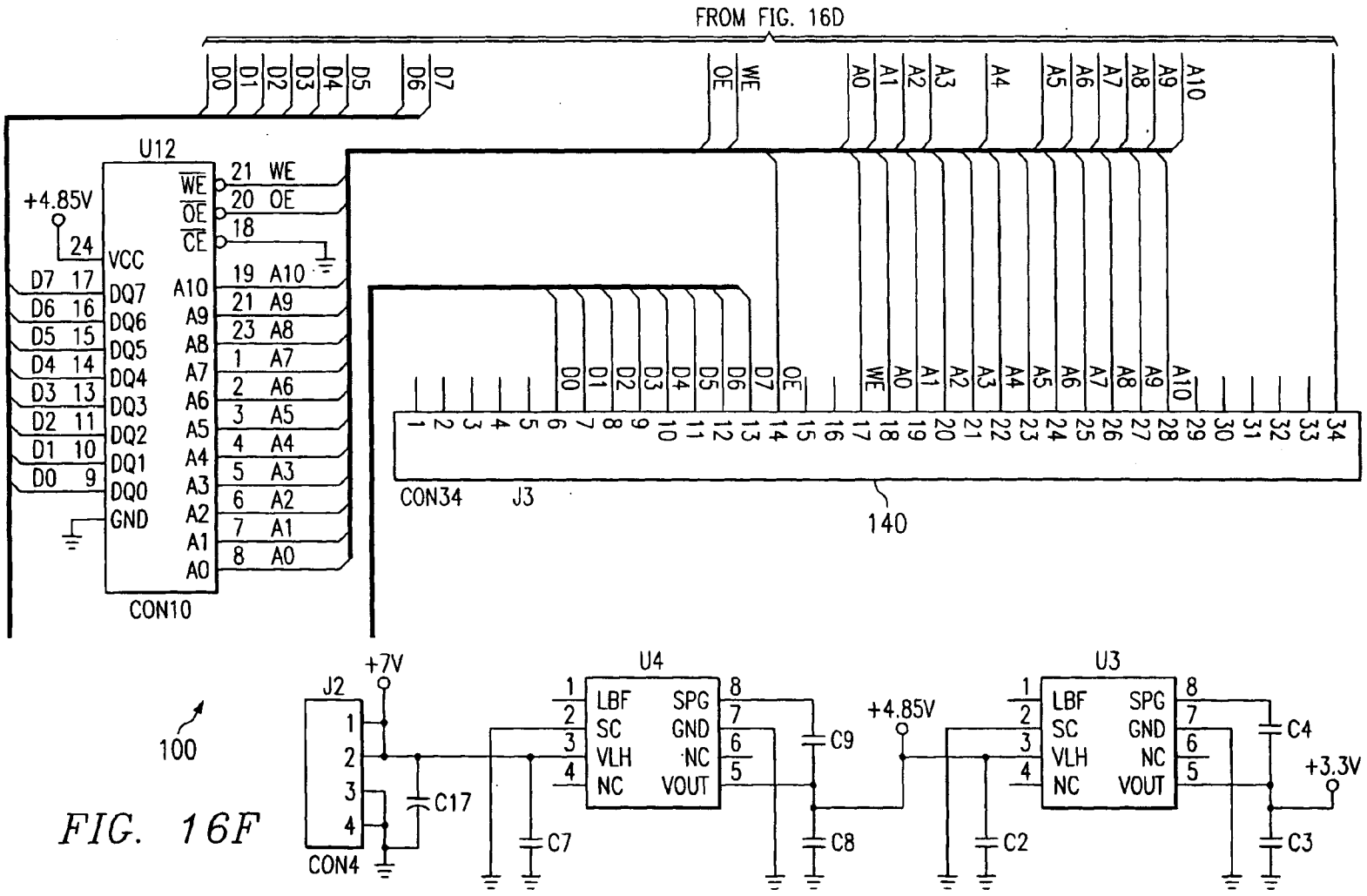
Figure 16G:
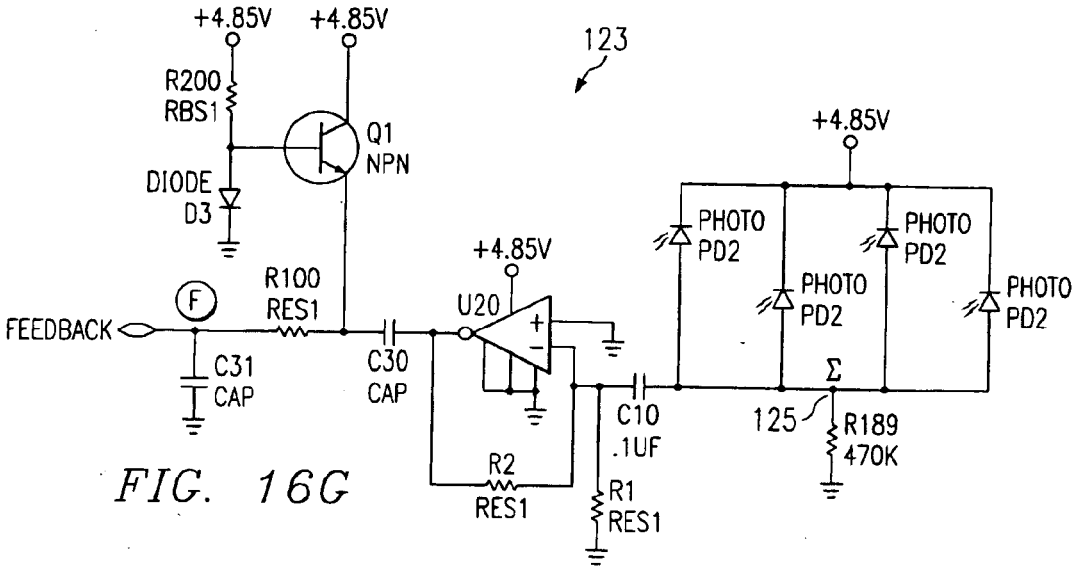
FIG. 16G is a schematic of the optical feedback circuit measuring the pulsed backscattered light from the Fresnel lens and providing an indicative DC voltage signal to the control electronics for maintaining an appropriate beams intensity.
Figure 16I:
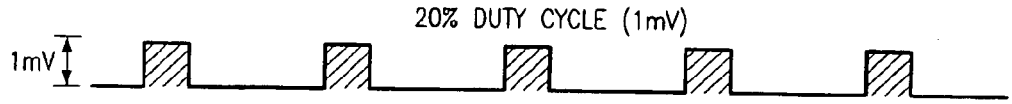
FIGS. 16I–K illustrate the varying PWM duty cycles and above currents used to adjust the LED light output as a function of the optical feedback circuit.
Figure 16J:
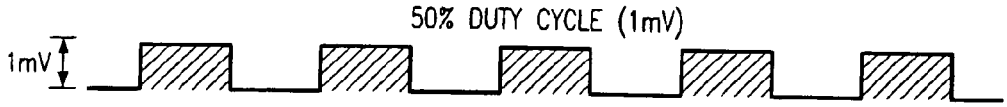
Figure 16K:
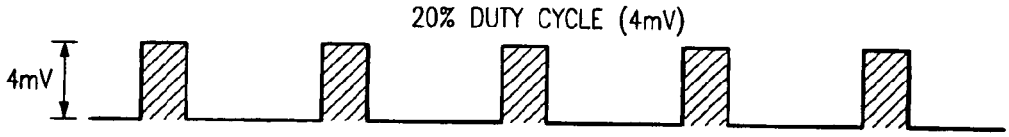
Figure 16H:
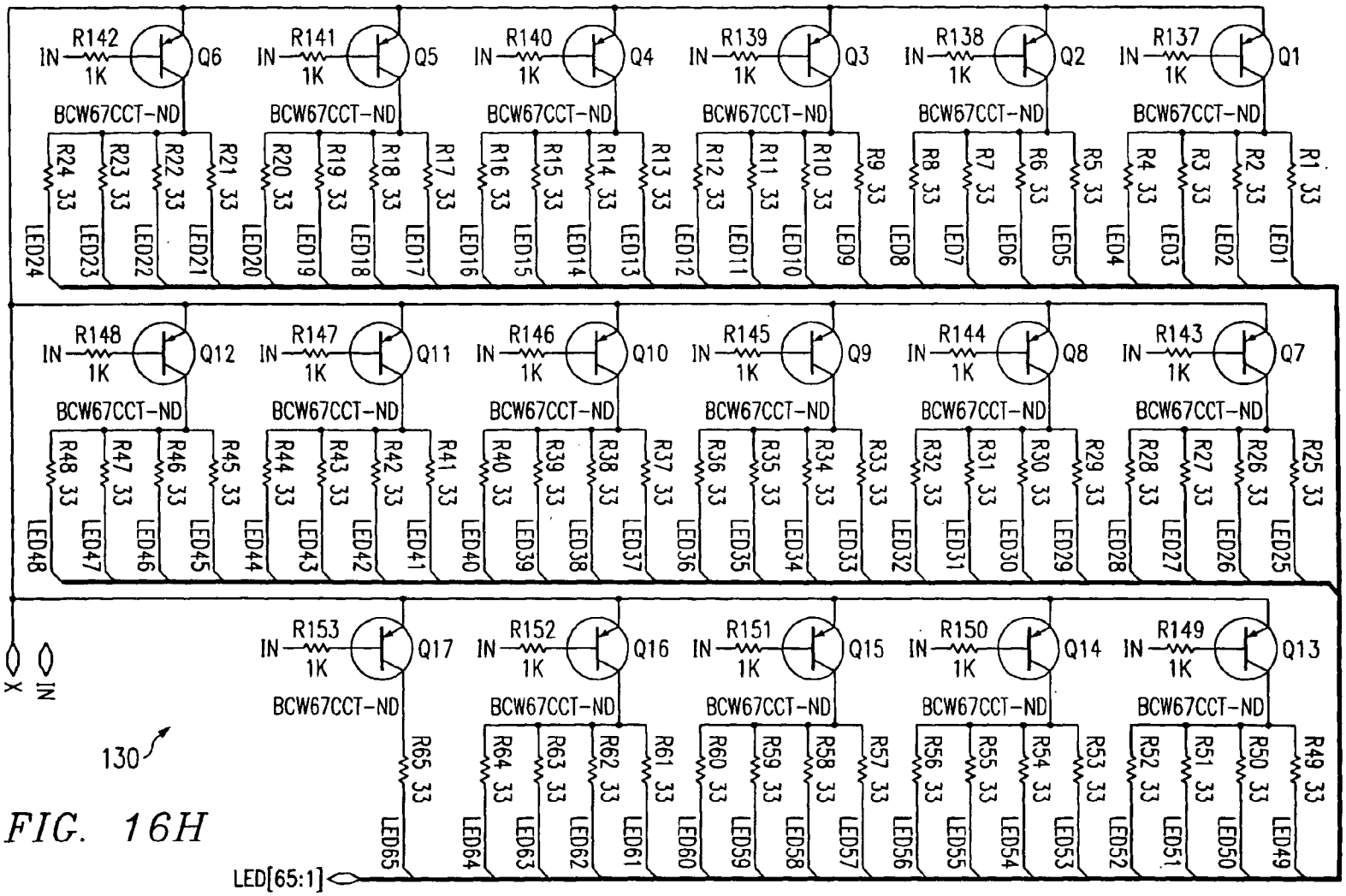
FIG. 16H is a schematic of the LED drive circuitry.

For instance, if the sensed back-scattered light, depicted as rays 124 in FIG. 3, is detected by photodiodes PD2 to fall about 2.5% from the normalized expected light to be sensed by photodiodes PD2, such as due to age of the LEDs 42, CPLD U1 responsively increases the drive current by increasing the PWM duty cycle, as shown in FIG. 16E, to the LEDs a predicted percentage, until the back-scattered light as detected by photodiodes PD2 is detected to be the normalized sensed light intensity. Alternatively, or in addition, the drive current to the LED's can be reversed as shown in FIG. 16F. Thus, as the light output of LEDs 42 degrade over time, which is typical with LEDs, circuit 100 compensates for such degradation of light output, as well as for the failure of any individual LED to ensure that light generated by array 40 and transmitted through window 16 meets Department of Transportation (DOT) standards, such as a 44 point test. This optical feedback compensation technique is also advantageous to compensate for the temporary light output reduction when LEDs become heated, such as during day operation, known as the recoverable light, which recoverable light also varies over temperatures as well. Permanent light loss is over time of operation due to degradation of the chemical composition of the LED semiconductor material.

Preferably, each of the LEDs is driven by a pulse width modulated (PWM) drive signal, providing current during a predetermined portion of the duty cycle, such as for instance, 50%. As the LEDs age and decrease in light output intensity, and also during day operation due to daily temperature variations, the duty cycle and/or drive current may be responsively, slowly and continuously increased or adjusted such that the duty cycle and/or drive current until the intensity of detected light using photodiodes PD2 is detected by comparator U10 to be the normalized detected light for the operation, i.e. day or night, as a function of the ambient light. When the light sensed by photodides PD2 are determined by controller 60 to fall below a predetermined threshold indicative of the overall light output being below DOT standards, a notification signal is generated by the CPLD U1 which may be electronically generated and transmitted by an RF modem, for instance, to a remote operator allowing the dispatch of service personnel to service the light. Alternatively, the apparatus 10 can responsively be shut down entirely.

Figure 18B:
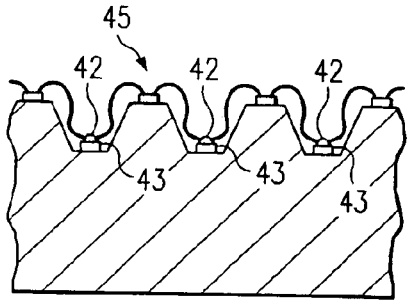
FIG. 18A and FIG. 18B are side sectional views of an alternative preferred embodiment including a heatsink with recesses, with the LED's wired in parallel and series, respectively.
Figure 18A:
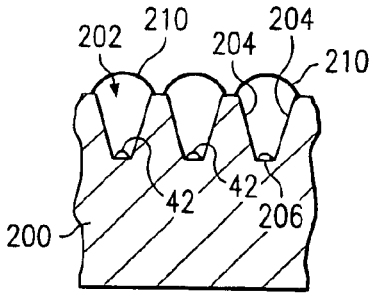

Referring now to FIG. 18A and FIG. 18B, there is shown an alternative preferred embodiment of the present invention including a heatsink 200 machined or stamped to have an array of reflectors 202. Each recess 202 is defined by outwardly tapered sidewalls 204 and a base surface 208, each recess 202 having mounted thereon a respective LED 42. A lens array having a separate lens 210 for each LED 42 is secured to the heatsink 200 over each recess 202, eliminating the need for a lens holder. The tapered sidewalls 206 serve as light reflectors to direct generated light through the respective lens 210 at an appropriate angle to direct the associated light to the diffuser 50 having the same surface area of illumination for each LED 42. In one embodiment, as shown in FIG. 18A, LEDs 42 are electrically connected in parallel. The cathode of each LED 42 is electrically coupled to the electrically conductive heatsink 200, with a respective lead 212 from the anode being coupled to drive circuitry 216 disposed as a thin film PCB 45 adhered to the surface of the heatsink 200, or defined on the daughterboard 60 as desired. Alternatively, as shown in FIG. 18B, each of the LED's may be electrically connected in series, such as in groups of three, and disposed on an electrically non-conductive thermally conductive material 43 such as ceramic, diamond, SiN or other suitable materials. In a further embodiment, the electrically non-conductive thermally conductive material may be formed in a single process by using a semiconductor process, such as diffusing a thin layer of material in a vacuum chamber, such as 8000 Angstroms of SiN, which a further step of defining electrically conductive circuit traces 45 on this thin layer.

Figure 19:
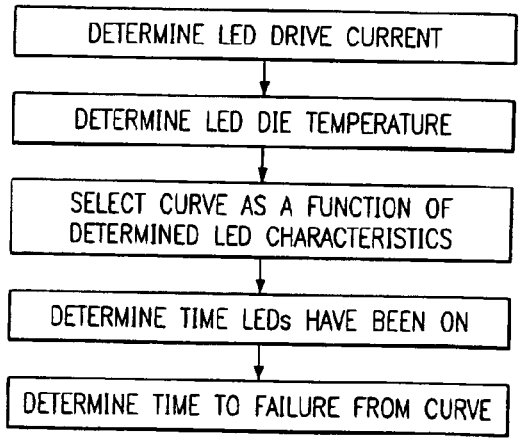
FIG. 19 is an algorithm depicting generating information indicative of the light operation, function and prediction of when the said state apparatus will fail or provide output below acceptable light output.
Figure 20:
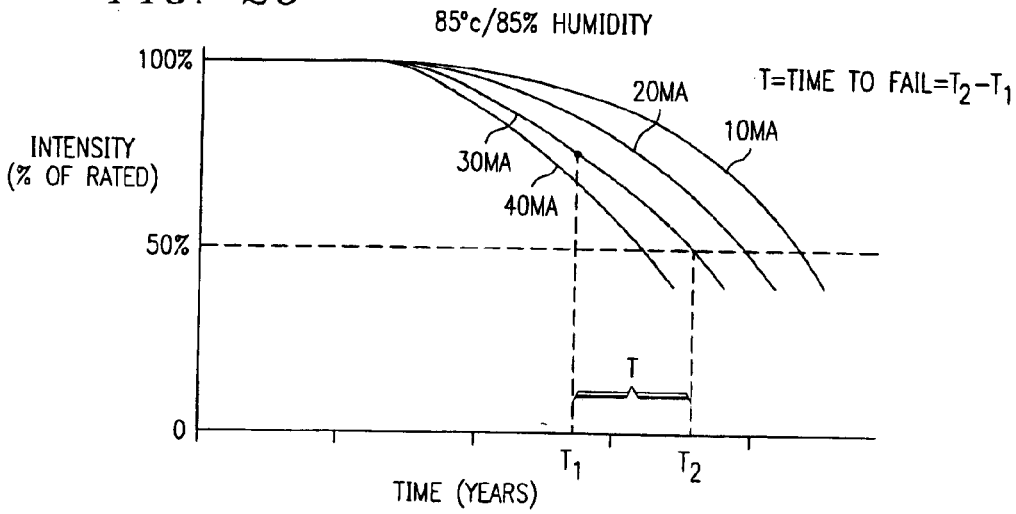
FIGS. 20 and 21 illustrate operating characteristics of the LEDs as a function of PWM duty cycles and temperature as a function of generated output light.
Figure 21:
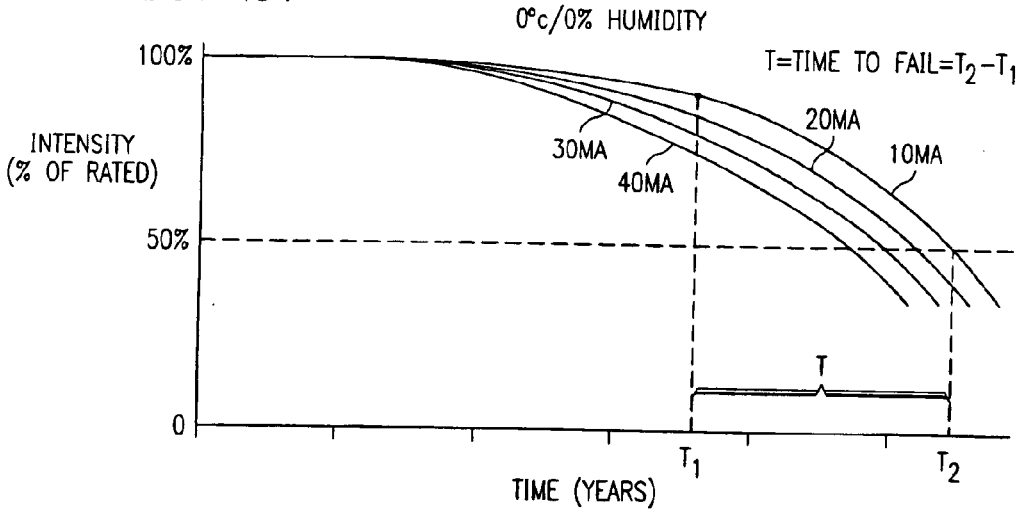

FIG. 19 shows an algorithm controller 60 applies for predicting when the solid state light apparatus will fail, and when the solid state light apparatus will produce a beam of light having an intensity below a predetermined minimum intensity such as that established by the DOT. Referring to the graphs in FIGS. 20 and 21, the known operating characteristics of the particular LEDs produced by the LED manufacture are illustrated and stored in memory, allowing the controller 60 to predict when the LED is about the fail. Knowing the LED drive current operating temperature, and total time the LED as been on, the controller 60 determines which operating curve in FIG. 20 and FIG. 21 applies to the current operating conditions, and determines the time until the LED will degrade to a performance level below spec, i.e. below DOT minimum intensity requirements.

Figure 22:
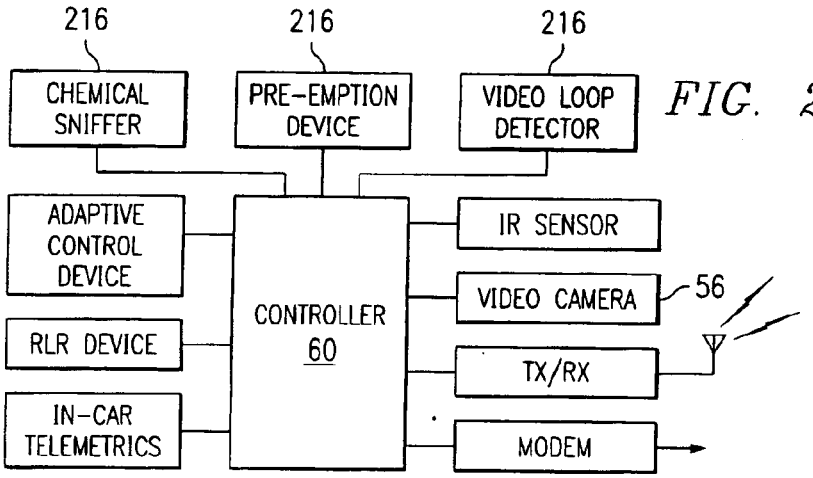
FIG. 22 is a block diagram of a modular light apparatus having selectively interchangeable devices that are field replaceable.

FIG. 22 depicts a block diagram of the modular solid state traffic light device. The modular field-replaceable devices are each adapted to selectively interface with the control logic daughterboard 60 via a suitable mating connector set. Each of these modular field replaceable devices 216 are preferably embodied as a separate card, with possibly one or more feature on a single field replaceable card, adapted to attach to daughterboard 60 by sliding into or bolting to the daughterboard 60. The devices can be selected from, alone or in combination with, a pre-emption device, a chemical sniffer, a video loop detector, an adaptive control device, a red light running (RLR) device, and an in-car telematic device, infrared sensors to sense people and vehicles under fog, rain, smog and other adverse visual conditions, automobile emission monitoring, various communication links, electronically steerable beam, exhaust emission violations detection, power supply predictive failure analysis, or other suitable traffic devices.

The solid state light apparatus 10 of the present invention has numerous technical advantages, including the ability to sink heat generated from the LED array to thereby reduce the operating temperature of the LEDs and increase the useful life thereof. Moreover, the control circuitry driving the LEDs includes optical feedback for detecting a portion of the back-scattered light from the LED array, as well as the intensity of the ambient light, facilitating controlling the individual drive currents, drive voltages, or increasing the duty cycles of the drive voltage, such that the overall light intensity emitted by the LED array 40 is constant, and meets DOT requirements. The apparatus is modular in that individual sections can be replaced at a modular level as upgrades become available, and to facilitate easy repair. With regards to circuitry 100, CPLD U1 is securable within a respective socket, and can be replaced or reprogrammed as improvements to the logic become available. Other advantages include programming CPLD U1 such that each of the LEDs 42 comprising array 40 can have different drive currents or drive voltages to provide an overall beam of light having beam characteristics with predetermined and preferably parameters. For instance, the beam can be selectively directed into two directions by driving only portions of the LED array in combination with lens 70 and 72. One portion of the beam may be selected to be more intense than other portions of the beam, and selectively directed off axis from a central axis of the LED array 40 using the optics and the electronic beam steering driving arrangement.

Figure 24:
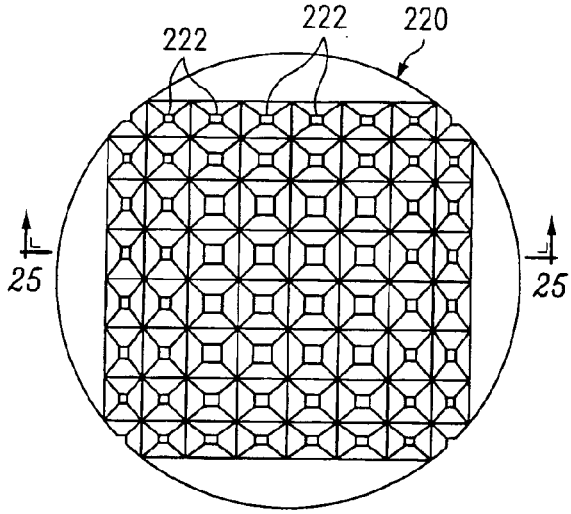
FIG. 24 shows a top view of FIG. 23 of the light guide for use with the diffuser.
Figure 23:
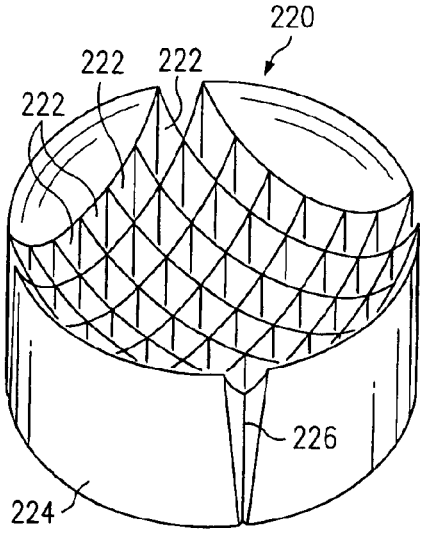
FIG. 23 is a perspective view of a light guide having a light channel for each LED to direct the respective LED light to the diffuser.
Figure 25:
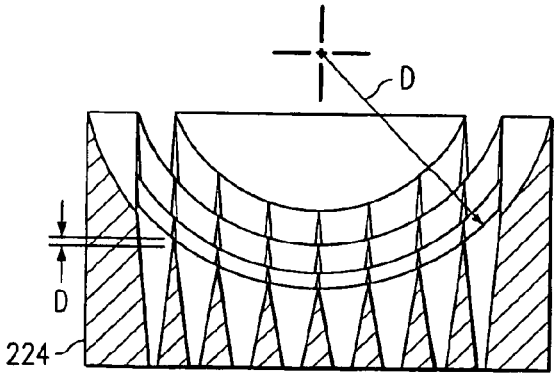
FIG. 25 shows a side sectional view taken along line 24—24 in FIG. 3 illustrating a separate light guide cavity for each LED extending to the light diffuser.

Referring now to FIG. 23, there is shown at 220 a light guide device having a concave upper surface and a plurality of vertical light guides shown at 222. One light guide 222 is provided for and positioned over each LED 42, which light guide 222 upwardly directs the light generated by the respective LED 42 to impinge the outer surface of the diffuser 54. The guides 222 taper outwardly at a top end thereof, as shown in FIG. 24 and FIG. 25, such that the area at the top of each light guide 222 is identical. Thus each LED 42 illuminates an equal surface area of the light diffuser 54, thereby providing a uniform intensity light beam from light diffuser 54. A thin membrane 224 defines the light guide, like a honeycomb, and tapers outwardly to a point edge at the top of the device 220. These point edges are separated by a small vertical distance D shown in FIG. 25, such as 1 mm, from the above diffuser 54 to ensure uniform lighting at the transition edges of the light guides 222 while preventing bleeding of light laterally between guides, and to prevent light roll-off by generating a homogeneous beam of light. Vertical recesses 226 permit standoffs 52 extending along the sides of device 220 (see FIG. 3) to support the peripheral edge of the diffuser 54.

Figure 26A:
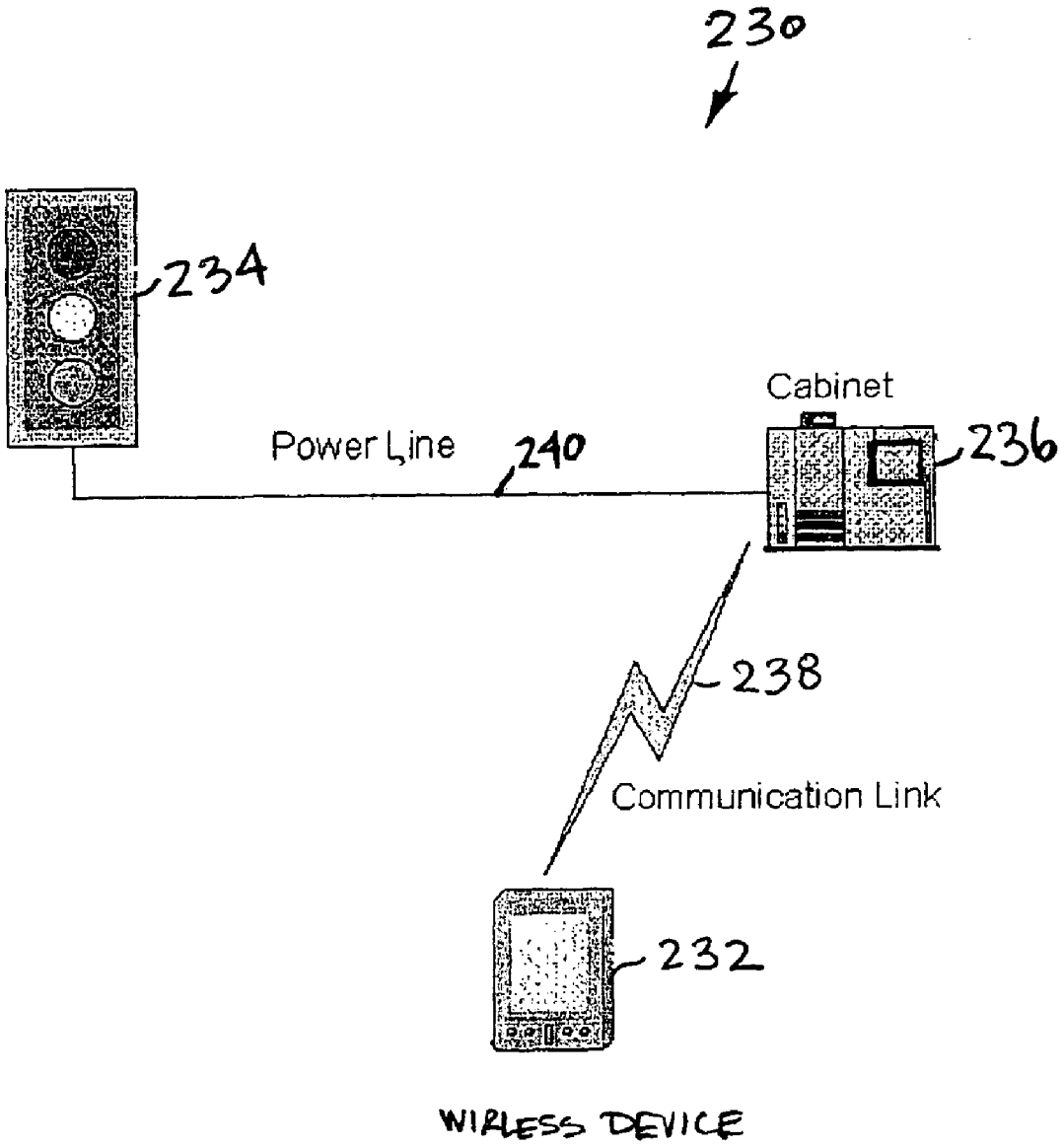
FIG. 26A depicts a system for configuring an electronically steerable beam of a traffic signal light in accordance with an exemplary embodiment of the present invention.

Referring now to FIG. 26A, a system 230 of the present invention is depicted. The system 230 preferably comprises software operating on a wireless device 232, a control unit (not shown), and a traffic signal light Light Emitting Diode (LED) array (described further below). The system 230, and more specifically the software operating on the wireless device 232, the control unit, and the LED array, are adapted to configure an electronically steerable beam (not shown) of a traffic signal light 234 to a desired viewing angle. The wireless device 232 may be a Personal Digital Assistant, a mobile or cellular telephone, a laptop, a tablet PC, and/or any electronic device that can wirelessly receive and/or transmit information. In another embodiment, the device may be a wired device or a wireless device docked or connected to a wired device. One or more control units may exist in the system 230 and the control units may be comprised of hardware, software, and/or a combination of hardware and software. The control unit may further be a stand alone unit, or a unit enclosed by the wireless device 232, enclosed by the traffic signal light 234, and/or enclosed by a cabinet 236. The cabinet 236 may be an intersection cabinet, a telecommunications cabinet, and/or any cabinet containing a means for delivering information to the traffic signal light 234.

A communication link 238 allows information to be sent from the device 102 to the control unit housed in the cabinet 236. The communication link 238 may be a wireless link, a wired link, and/or a combination of a wireless and wired link. A power line 240 allows information to be sent from the control unit housed in the cabinet 236 to the LED array housed in the traffic signal light 234. In an alternate embodiment, communication from the control unit to the traffic signal light 234 may occur via a wireless communication link, a wired communication link, and/or a combination of a wireless and a wired communication link. In another alternate embodiment, other information from the wireless device 232 can be sent to the control unit, and other information from other components in the cabinet 236 can be sent to the traffic signal light 234.

In yet another alternate embodiment, information can be exchanged between the control unit housed in the cabinet 236 and the wireless device 232, between the control unit and the traffic light signal 234, between the control unit and the LED array, between the LED array and the wireless device, and/or between the traffic light signal and the wireless device. For example, the traffic light signal 234 and/or the control unit could send the wireless device 232 updates, status messages, alarms, or various other information relating to the control unit, the cabinet 236, the traffic signal light 234, the communication link 238, and/or the power line 240. Such various other information may include suggestions to further configure the electronically steerable beam to a different viewing angle based on a current traffic situation, a potential traffic situation, a weather situation, and/or any activity that could impact a viewing angle of all of or a portion of the traffic signal light 234.

Figure 26B:
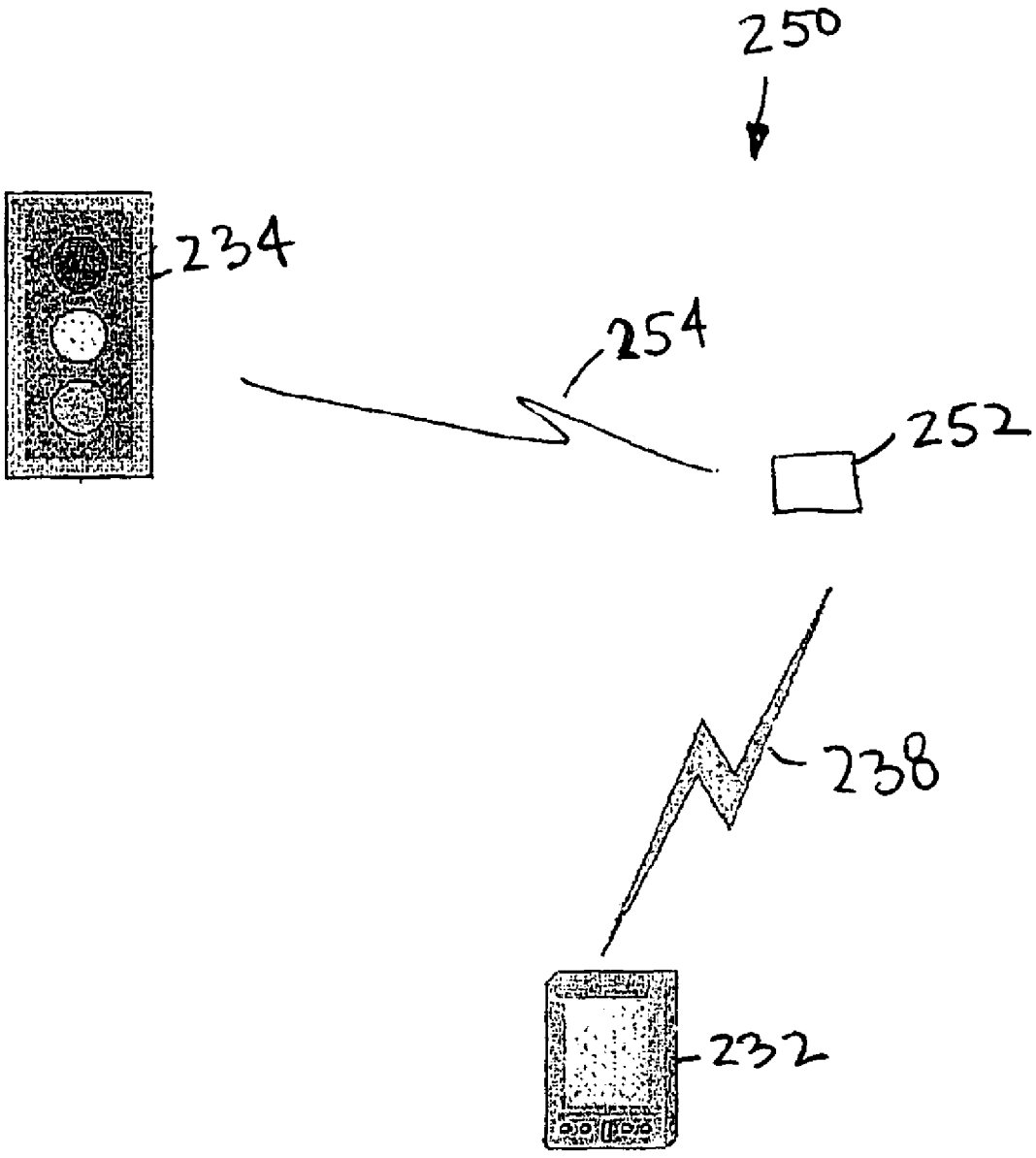
FIG. 26B depicts an alternate system for configuring an electronically steerable beam of a traffic signal light in accordance with an exemplary embodiment of the present invention.

Referring now to FIG. 26B, an alternate system 250 of the present invention is depicted. The system 250 preferably comprises software operating on a wireless device 232, a control unit 252, and a traffic signal light LED array (described further below). The system 250, and more specifically the software operating on the wireless device 232, the control unit 252, and the LED array, are adapted to configure an electronically steerable beam of a traffic signal light 234 to a desired viewing angle. In the system 250, the control unit 252 is a stand alone unit and communicates with the LED array via a communication link 254 which may be a wireless link, a wired link, and/or a combination of a wireless and a wired link.

In an alternate embodiment, the control unit may be contained in another device such as another wireless device, a computer, and/or any device able to communicate with an LED array of a traffic signal light and/or with any other element of a traffic signal light.

Figure 26C:
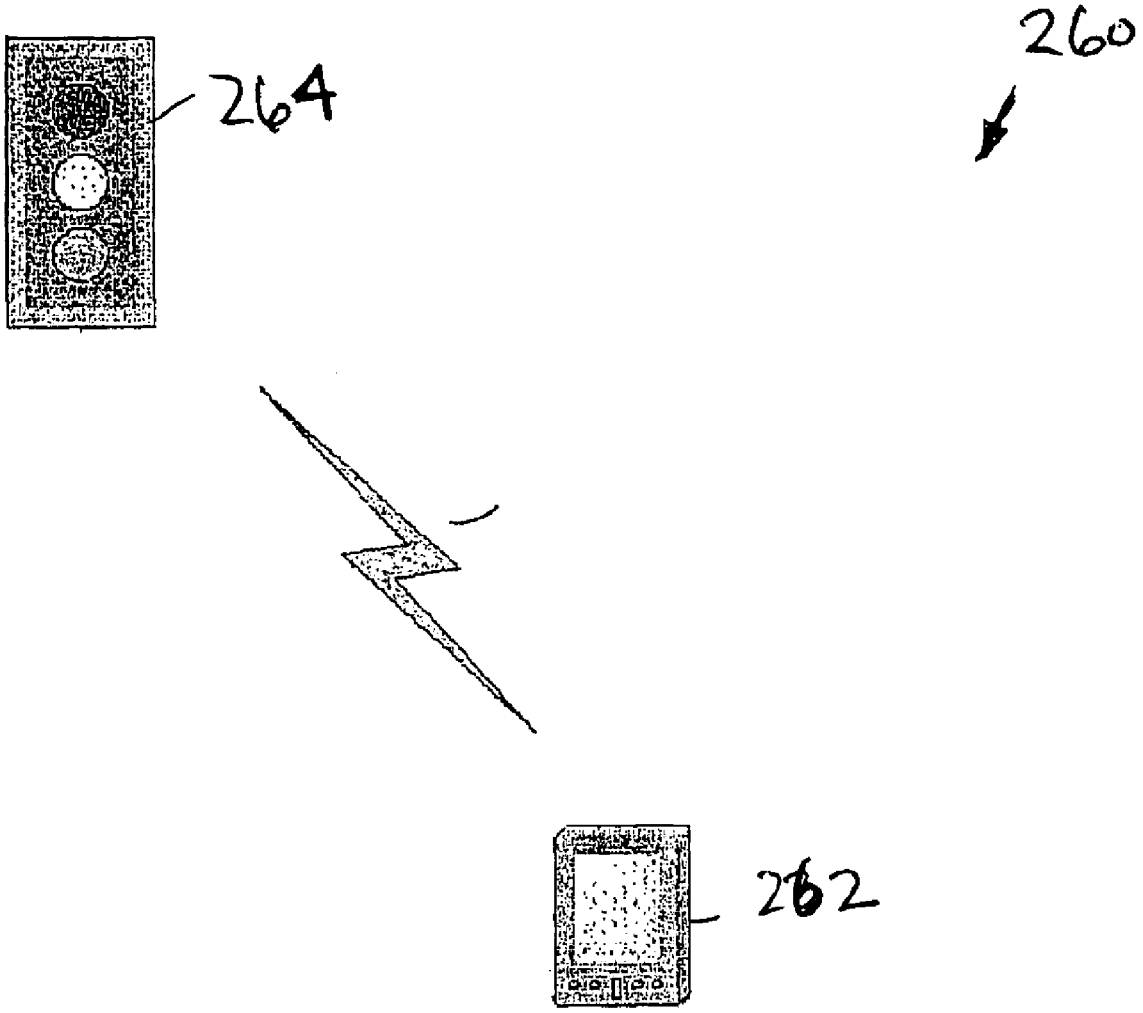
FIG. 26C depicts another alternate system for configuring an electronically steerable beam of a traffic signal light in accordance with an exemplary embodiment of the present invention.

Referring now to FIG. 26C, another alternate system 260 of the present invention is depicted. The system 260 preferably comprises software operating on a wireless device 262, a control unit (not shown), and a traffic signal light LED array (described further below). The system 260, and more specifically the software operating on the wireless device 262, the control unit, and the LED array, are adapted to configure an electronically steerable beam of a traffic signal light 264 to a desired viewing angle. In the system 260, the control unit is preferably located within the traffic signal light 264 and is in communication with the traffic signal light LED. In another embodiment, the control unit may be located within the wireless device 262, and in a further embodiment, one or more control units may be fully and/or partially located with the wireless device 262 and the traffic signal light 264.

Further described, an embodiment of the present invention allows an electronically steerable beam of a traffic signal light to be configured to a desired viewing angle remotely using an interactive methodology. At least one command to change the viewing angle of a specific traffic light are entered using a wireless device. The command is then sent over a communication link to a control unit within a cabinet. After receiving the command, the control unit translates the command to a power line command and sends it over that interface. The power line to the traffic light signal can be used as a low cost communication channel by modulating the signal and adding it to a power line voltage. The addressed light adjusts its viewing angle and stores this state in its flash memory. This command response cycle can be completed in milliseconds, which will allow the operator to interactively adjust the viewing angle optimally within a very short time.

Configuration of the electronically steerable beam traffic signal light is usually performed once after installation of the traffic signal light. The state of the light is retained in its flash memory, and whenever the light is powered on, it will start with the desired viewing angle. Security in the communication channel is achieved by using encrypted secure protocols.

Precisely controlling the viewing angle of the traffic signal light eliminates possible ambiguity associated with an intersection having multiple light ball lenses and multiple traffic signals. The wireless device or remote control unit allows the electronically steerable beam to be controlled from the vantage point of a vehicle at an intersection. From this point of view, a traffic engineer, for example, can interactively determine an optimal viewing angle. An example of the wireless device 232, 262, is depicted in FIG. 27.

Figure 27:
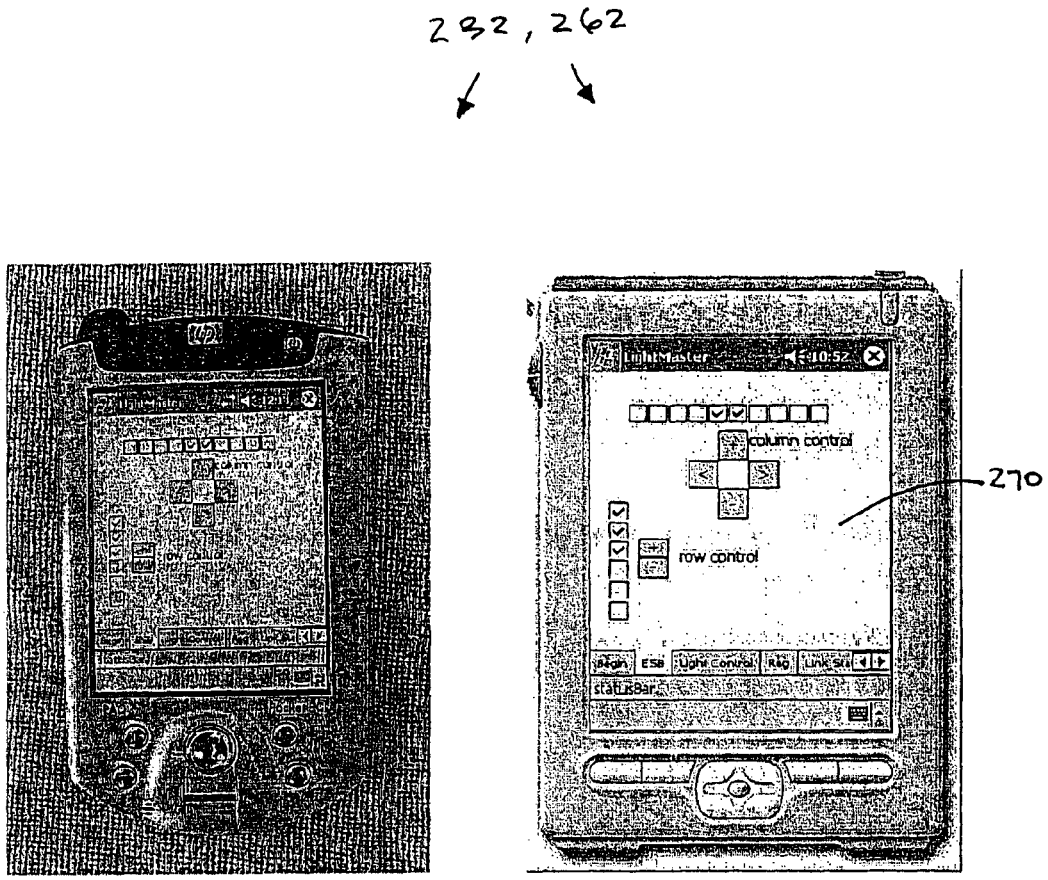
FIG. 27 depicts a Graphical User Interface (GUI) adapted to configure an electronically steerable beam of a traffic signal light in accordance with an exemplary embodiment of the present invention.

Referring now to FIG. 27, a graphical user interface (GUI) 270 allows control over the columns and rows of the LED array. Control can be exercised using a touch screen of the wireless device 232, 262 or its physical buttons, such as its "arrow keys." A plurality of "checkboxes," such as for example ten checkboxes, allow individual columns and/or portions of individual columns to be turned on or off. A "left shift button" and a "right shift button" shift the pattern of on columns left or right, thus shifting the viewing angle correspondingly. An "expand button," denoted by an addition sign, increases the viewing angle by turning on additional columns to the left and right of the current set of on columns. A "contract button," denoted by a subtraction sign, decreases the viewing angle by turning off the left and right most on columns of the array. Row control is handled in a similar manner. It should be noted that a greater and/or a lesser number of elements such as checkboxes, shift buttons, expand buttons, contract buttons may be implemented by the present invention. Further, the layout of such elements can be altered. Also, different elements can be provided and/or utilized to enhance the ability of controlling columns and rows of an LED array. Such controlling is not limited to the wireless device's 232, 262 GUI. It is also possible for the wireless device 232, 262 to accept voice commands.

In an alternate embodiment, a resulting pictorial view associated with the element selection can be displayed via the wireless device 232, 262. Further, a desired view, based on a location of a traffic engineer, can be sent to the control unit which can convert such a location to an associated viewing angle and provide such a viewing angle.

Figure 28:
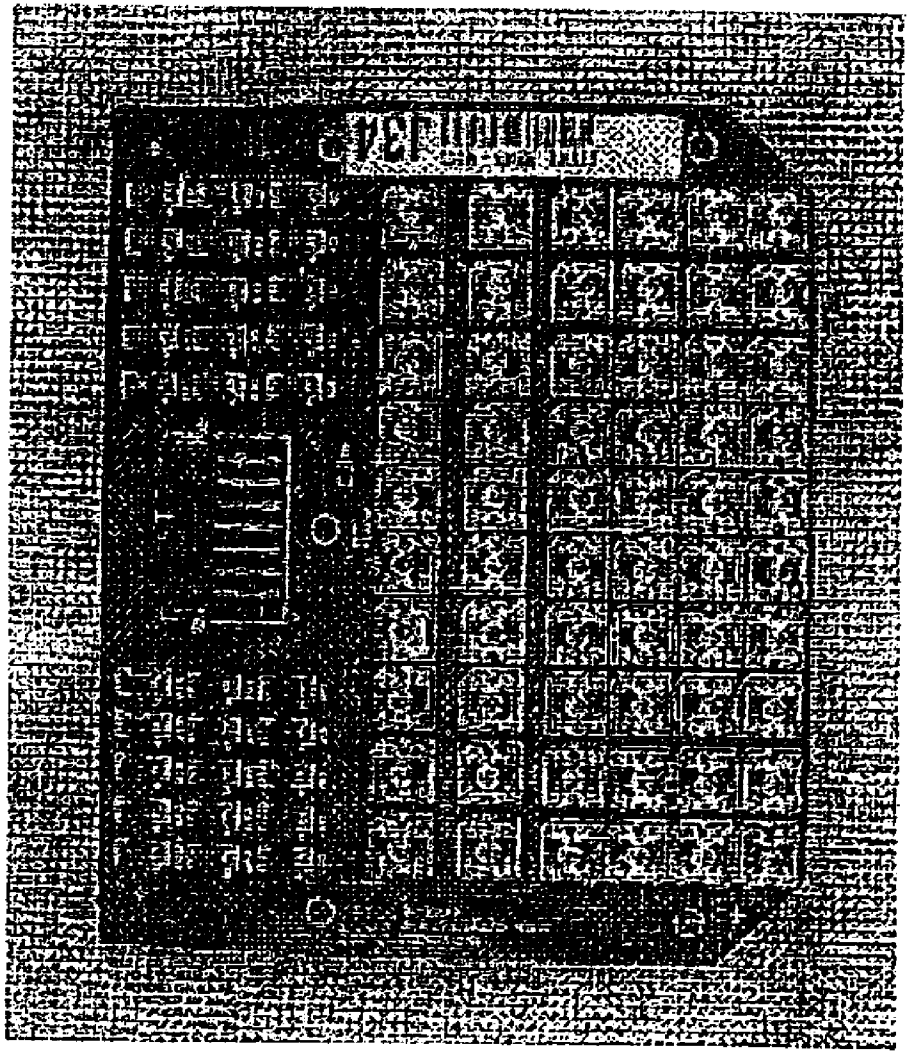
FIG. 28 depicts a traffic signal light Light Emitting Diode array in accordance with an exemplary embodiment of the present invention.

Referring now to FIG. 28, an LED array 280 is depicted. The LED array 28 is used as the light source for the electronically steerable beam traffic signal. In general, the array 280 is an N column by M row array of individual LEDs with column and row control lines to configure the traffic signal light LEDs. Turning on or off the rows and columns of the array controls the viewing angle of the traffic signal. A narrow horizontal viewing angle is achieved with a small number of columns (i.e. more columns off) and a wider viewing angle is attained with a large number of columns (i.e. more columns on). Similarly, the vertical viewing angle is adjusted by controlling the rows of the LED array 28. Both row and column control can by exercised independently and/or simultaneously. By example, the LED array 280 is depicted as a 10 by 6 array. In an alternate embodiment, individual LEDs of the array 280 can be controlled.

An advanced traffic light command protocol for controlling an electronically steerable beam preferably contains the following format: ESB column_bits row_bits where column_bits is an integer whose binary representation encodes the column on/off states and row_bits is an integer whose binary representation encodes the row on/off states. For example, the 10 by 6 array 280 would use column_bits values between 0 and 1023 to allow control of all 10 columns of the array.

Described further, the protocol includes the following commands that are preferably implemented by the control unit 252. Each of the commands appears in the left box and its response appears in the right box. The command protocol can be encapsulated into a power line modem protocol, for example, which may further be encapsulated within TCP/IP, for example. The serial interface is preferably 4800 bps uplink and 9600 bps downlink, 8 data bits, 1 stop bit and no parity. Other commands may be added and the present commands may be altered or deleted, and other serial interfaces may be used and the preferred interface may be altered.

---

Set the ESB LED array columns and rows

SP ESB <column bits><row bits> OK

This command will set the columns and rows on and off. <columns bits> is a decimal num who's binary interpretation controls the columns of the ESB LED array. Bit zero controls column zero of the LED array. <row bits> is also a used to control the rows of the LED array. Bit zero controls row zero.

Get the ESB LED array columns and rows

GP ESB <column bits><row bits> <column bits><row bits>

This command will returns the columns and rows of the ESB LED array. <columns bits> is a decimal num who's binary interpretation represents the columns of the ESB LED array. Bit zero is column zero of the LED array. <row bits> is also a used to represent the rows of the LED array.

-continued

| |
|---|
| Bit zero is row zero. |

The software running on the wireless device 232, 262 is adapted to translate the actions of the user and the screen to a command in the above format. Speech recognition may be used to control the electronically steerable beam by voice. Phrases spoken by the user are translated into electronically steerable beam column commands and/or row commands. The following table is a list of voice commands, but does not preclude other voice commands:

| |
|---|
| Shift left |
| Shift right |
| All columns on |
| All columns off |
| All rows on |
| All rows off |
| Increase horizontal viewing angle |
| Decrease horizontal viewing angle |
| Shift up |
| Shift down |
| Increase vertical viewing angle |
| Decrease vertical viewing angle |

Figure 29:
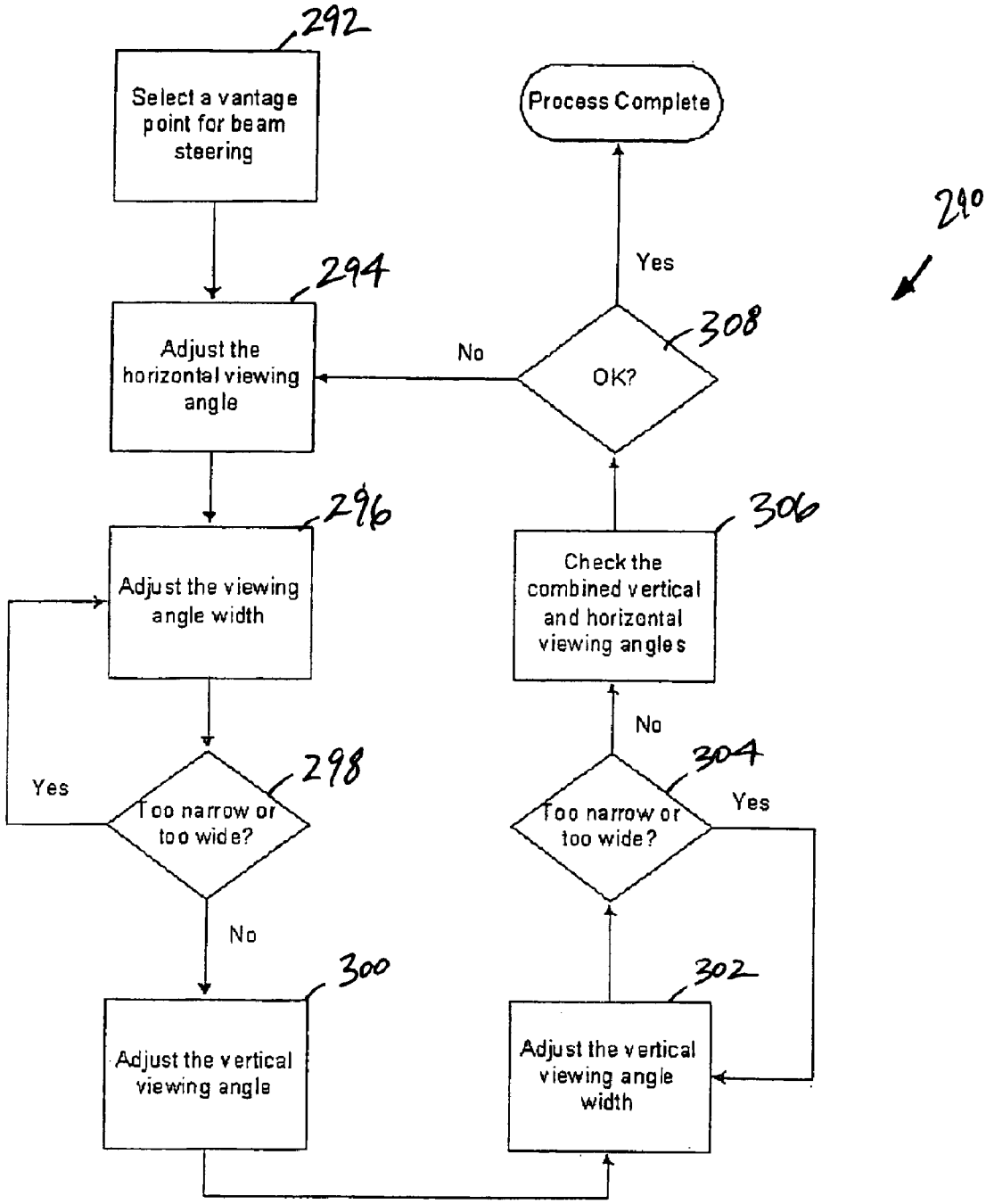
FIG. 29 depicts a flowchart for adjusting viewing angles of a traffic signal light in accordance with an exemplary embodiment of the present invention.

Referring now to FIG. 29, a flowchart 290 for configuring an electronically steerable beam of a traffic light is presented. At step 292, a user, such as a traffic engineer, selects a vantage point within an intersection that is best for the signal light being adjusted. The horizontal viewing angle is then adjusted and set at step 294. The width of the horizontal viewing angle is then adjusted at step 296. At step 298, a determination is made regarding the width of the horizontal viewing angle. If the width is too narrow or wide, or otherwise not proper, the width is again adjusted at step 296 until it is correct.

The vertical viewing angle is then adjusted and set at step 300. The width of the vertical viewing angle is then adjusted at step 302. At step 304, a determination is made regarding the width of the vertical viewing angle. If the width is too narrow or wide, or otherwise not proper, the width is again adjusted at step 302 until it is correct. Finally the overall angles are checked at step 306 and if correct the process is complete. If they are not satisfactory, then the horizontal viewing angle is again adjusted and set at step 294 and the process continues as described above.

While the invention has been described in conjunction with preferred embodiments, it should be understood that modifications will become apparent to those of ordinary skill in the art and that such modifications are therein to be included within the scope of the invention and the following claims.

What is claimed is:

1. A method for configuring an electronically steerable beam of a traffic signal light, comprising:

receiving at least one command to change a viewing angle of a traffic signal light;

translating the command to a power line command;

sending the power line command to the traffic signal light, wherein the power line command effects an electronic steerable beam of the traffic signal light; and adjusting a viewing angle of at least a portion of the traffic signal light based on the power line command.

2. The method of claim 1 further comprising storing the viewing angle.

3. The method of claim 1 further comprising interactively adjusting the viewing angle.

4. The method of claim 1 further comprising dynamically adjusting the viewing angle.

5. The method of claim 1 further comprising adjusting the viewing angle based on a vantage point of a vehicle at a location proximate the traffic signal light.

6. The method of claim 1 further comprising encrypting at least one of a following command from a group consisting of:

the at least one command; and the power line command.

7. The method of claim 1, wherein the command is received in at least one of a following manner from a group consisting of:

a wireless connection;

a wired connection; and a combination wireless and wired connection.

8. The method of claim 1, wherein the power line command is sent in at least one of a following manner from a group consisting of:

a wireless connection;

a wired connection; and a combination wireless and wired connection.

9. A computer readable medium comprising instructions for:

receiving a command to change a viewing angle of at least one traffic signal light;

wherein a Light Emitting Diode of the traffic signal light comprises an array of columns and rows;

performing at least one of a following action, based on the command, from a group consisting of:

turning at least one of the columns on;

turning at least one of the columns off;

turning at least one of the rows on; and turning at least one of the rows off; and changing the viewing angle based on the performed action.

10. The computer readable medium of claim 9 further comprising increasing the viewing angle by performing at least one of the following actions from a group consisting of:

turning the at least one of the columns on;

turning a portion of the at least one of the columns on;

turning the at least one of the rows on; and turning a portion of the at least one of the rows on.

11. The computer readable medium of claim 9 further comprising decreasing the viewing angle by performing at least one of the following actions from a group consisting of:

turning the at least one of the columns off;

turning a portion of the at least one of the columns off;

turning the at least one of the rows off; and turning a portion of the at least one of the rows off.

12. The computer readable medium of claim 9 further comprising increasing the viewing angle by turning the at least one of the columns on situated to a side of a current on column from a group consisting of:

a left side; and a right side.

13. The computer readable medium of claim 9 further comprising increasing the viewing angle by turning the at least one of the columns on situated to a side of a current off column from a group consisting of:

a left side; and a right side.

14. The computer readable medium of claim 9 further comprising decreasing the viewing angle by turning the at least one of the columns off situated to a side of a current on column from a group consisting of:

a left side; and a right side.

15. The computer readable medium of claim 9 further comprising decreasing the viewing angle by turning the at least one of the columns off situated to a side of a current off column from a group consisting of:

a left side; and a right side.

16. The computer readable medium of claim 9 further comprising increasing the viewing angle by turning the at least one of the rows on situated to a side of a current on row from a group consisting of:

a top side; and a bottom side.

17. The computer readable medium of claim 9 further comprising decreasing the viewing angle by turning the at least one of the rows on situated to a side of a current off row from a group consisting of:

a top side; and a bottom side.

18. The computer readable medium of claim 9 further comprising increasing the viewing angle by turning the at least one of the rows off situated to a side of a current on row from a group consisting of:

a top side; and a bottom side.

19. The computer readable medium of claim 9 further comprising decreasing the viewing angle by turning the at least one of the rows off situated to a side of a current off row from a group consisting of:

a top side; and a bottom side.

20. The computer readable medium of claim 9 further comprising changing an electronically steerable beam of the traffic signal light based on the changed viewing angle.

21. The computer readable medium of claim 9 further comprising independently performing the at least one of the following action.

22. The computer readable medium of claim 9 further comprising contemporaneously performing the at least one of the following action.

23. A method for configuring an electronically steerable beam of a traffic signal light, comprising:

selecting a vantage point for beam steering;

adjusting at least one of a following viewing perspective of the traffic signal light from a group consisting of:

a horizontal viewing angle;

a horizontal viewing width;

a vertical viewing angle; and a vertical viewing width; and setting the adjusted at least one of the viewing perspectives.

24. The method of claim 23 further comprising adjusting the viewing perspectives by performing at least one of a following action from a group consisting of:

widening the horizontal viewing angle;

narrowing the horizontal viewing angle;

widening the horizontal viewing width; and narrowing the horizontal viewing width.

25. The method of claim 24 further comprising performing the narrowing by reducing at least one column associated with the traffic signal light.

26. The method of claim 24 further comprising performing the widening by increasing at least one column associated with the traffic signal light.

27. The method of claim 24 further comprising performing the narrowing by reducing at least a portion of at least one column associated with the traffic signal light.

28. The method of claim 24 further comprising performing the widening by increasing at least a portion of at least one column associated with the traffic signal light.

29. The method of claim 23 further comprising adjusting the viewing perspectives by performing at least one of a following action from a group consisting of:

widening the vertical viewing angle;

narrowing the vertical viewing angle;

widening the vertical viewing width; and narrowing the vertical viewing width.

30. The method of claim 29 further comprising performing the narrowing by reducing at least one row associated with the traffic signal light.

31. The method of claim 29 further comprising performing the widening by increasing at least one row associated with the traffic signal light.

32. The method of claim 29 further comprising performing the narrowing by reducing at least a portion of at least one row associated with the traffic signal light.

33. The method of claim 29 further comprising performing the widening by increasing at least a portion of at least one row associated with the traffic signal light.

34. A system for configuring an electronically steerable beam of a traffic signal light, comprising:

a wireless device adapted to send at least one command to change a viewing angle of a traffic signal light;

a control unit adapted to receive the command;

the control unit further adapted to:

translate the command to a power line command;

send the power line command to the traffic signal light, wherein the power line command effects an electronic steerable beam of the traffic signal light; and adjust a viewing angle of at least a portion of the traffic signal light based on the power line command.

35. A system for configuring an electronically steerable beam of a traffic signal light, comprising:

a wireless device adapted to send at least one command to change a viewing angle of a traffic signal light; and a control unit adapted to receive the command;

the control unit further adapted to send the command to the traffic signal light, wherein the command adjusts a viewing angle of at least a portion of the traffic signal light.

36. The system of claim 35, wherein the control unit is internally coupled to the traffic signal light.

37. The system of claim 35, wherein the control unit is externally coupled to the traffic signal light.

38. The system of claim 35, wherein the control unit is internally coupled to the wireless device.

39. The system of claim 35, wherein the control unit is externally coupled to the wireless device.

40. The system of claim 35, wherein the control unit is coupled to at least one Light Emitting Diode array of the traffic signal light.

41. The system of claim 35 further comprising receiving the at least one command by the wireless device.

42. The system of claim 41, wherein the received command is a voice command.

43. The system of claim 42, wherein the received command is received by a depressing of a portion of the wireless device, wherein the portion is at least one of a following portion from a group consisting of:

a touchscreen;

arrow keys; and a combination of a touch screen and arrow keys.

44. An electronic device, comprising:

means for receiving at least one command to change a viewing angle of a traffic signal light;

means for translating the command to a power line command;

means for sending the power line command to the traffic signal light, wherein the power line command effects an electronically steerable beam of the traffic signal light; and means for adjust a viewing angle of at least a portion of the traffic signal light based on the power line command.

45. A wireless device adapted to configure an electronically steerable beam of a traffic signal light to a desirable viewing angle and viewing width, wherein the traffic signal light comprises an array of columns and rows consisting of light emitting diodes, comprising:

means for performing at least one of a following action from a group consisting of:

shift left;

shift right;

all columns on;

all columns off;

all rows on;

all rows off;

increase horizontal viewing angle;

decrease horizontal viewing angle;

shift up;

shift down;

increase vertical viewing angle; and decrease vertical viewing angle.

46. A device comprising a graphical user interface adapted to configure an electronically steerable beam of a traffic signal light in order to alter a viewing angle of the traffic signal light, the traffic light signal including a Light Emitting Diode consisting of an array of columns and rows, the device comprising:

means for selecting at least a portion of at least one of the columns;

means for deselecting at least a portion of at least one of the columns;

means for turning on at least a portion of at least one of the columns;

means for turning off at least a portion of at least one of the columns;

means for selecting at least a portion of at least one of the rows;

means for deselecting at least a portion of at least one of the rows;

means for turning on at least a portion of at least one of the rows; and means for turning off at least a portion of at least one of the rows.

* * * * *